United States Patent [19]

Bartczak et al.

[11] Patent Number: 4,929,007

[45] Date of Patent: May 29, 1990

[54] LATCH MECHANISM

[75] Inventors: Andrzej Bartczak, Newmarket; Roman Cetnar, Aurora, both of Canada

[73] Assignee: Magna International Inc., Markham, Canada

[21] Appl. No.: 174,947

[22] Filed: Mar. 29, 1988

[30] Foreign Application Priority Data

Mar. 30, 1987 [CA] Canada ..... 533372
Jul. 31, 1987 [CA] Canada ..... 543600

[51] Int. Cl.[5] ..... E05C 3/26

[52] U.S. Cl. ..... 292/336.3; 292/216; 292/DIG. 27

[58] Field of Search ..... 292/DIG. 27, 280, 216, 292/336.3

[56] References Cited

U.S. PATENT DOCUMENTS

| | | | |
|---|---|---|---|
| 1,512,141 | 10/1924 | Segal | 292/49 |
| 2,118,729 | 5/1938 | Hogan | 292/27 |
| 3,007,731 | 11/1961 | Roethel | 292/DIG. 27 X |
| 3,309,127 | 3/1967 | Pickles | 292/DIG. 27 X |
| 3,385,623 | 5/1968 | Burns et al. | 292/DIG. 27 X |
| 3,523,704 | 8/1970 | Sandor | 292/216 |
| 3,525,545 | 8/1970 | Leslie | 292/216 |
| 3,904,230 | 9/1975 | Fane et al. | 292/27 |
| 4,005,887 | 2/1977 | Itakura | 292/216 |
| 4,045,064 | 8/1977 | Okada | 292/DIG. 27 X |
| 4,196,925 | 4/1980 | Torii | 292/216 |
| 4,289,342 | 9/1981 | Bemm et al. | 292/49 |
| 4,312,527 | 1/1982 | Tannery | 292/49 |
| 4,440,006 | 4/1984 | Kleefeldt | 70/264 |
| 4,487,441 | 12/1984 | Miyamoto et al. | 292/336.3 |
| 4,494,782 | 1/1985 | Lutz | 292/96 |

FOREIGN PATENT DOCUMENTS

| | | | |
|---|---|---|---|
| 1128094 | 7/1982 | Canada | 292/24 |

*Primary Examiner*—Richard E. Moore
*Attorney, Agent, or Firm*—Ivor M. Hughes

[57] ABSTRACT

An operating mechanism suitable for use in a vehicle door latch mechanism comprising structural components for locking, the operating mechanism comprising:

(a) an inside handle release lever for being operated from the inside of the door;

(b) an outside handle release lever for being operated from the outside of the door;

(c) structure for being engaged by the inside handle release lever and outside handle release lever, the structure being connected to release the structural components of the latch mechanism for operation;

(d) at least one of the inside handle release lever and outside handle release lever being movable to a position whereat the release lever cannot engage the structure to release the structural components when operated.

131 Claims, 21 Drawing Sheets

LATCH MECHANISM

FIELD OF INVENTION

This invention relates to door latch mechanisms and particularly to automobile door latch mechanisms and components therefor suitable for use in vehicle doors and particularly relates to the operator portions of such mechanisms used to operate the structural portions (for example ratchet and pawl).

BACKGROUND OF THE INVENTION

Vehicle door latch mechanisms normally contain two portions, a structural portion and an operator portion for operating the components of the structural portion. The structural portion usually comprises a pawl and a ratchet with the ratchet engaging and capturing a striker mounted on the body for securing the striker and thus securely closing the door to the car body.

Various proposals have been made for door latch mechanisms and operators some of which are shown in U.S. Pat. Nos. 3,523,704; 3,697,105; 3,848,910; 3,858,919; 4,334,704; 4,289,342; 4,196,925; 4,005,887; 4,440,006; 4,487,441 and 4,494,782. See also Canadian Letters Patent 1,128,094 and German Offenlegungsschrift 2,403,238.

U.S. Pat. No. 3,523,704 typifies older latch mechanisms employing four different levers and many other parts making the mechanism complex and costly to manufacture and assemble.

U.S. Pat. No. 3,697,105 purports to teach a "floating" pin for connection purposes. The pin floats in two slots in a release lever and locking lever.

U.S. Pat. No. 3,848,910 purports to teach a locking mechanism for doors or the like, especially for motor vehicle doors which contains a latching element engaging during the closing of the door in a closure member; the closed position of the latching element is locked by a locking pawl which is disengageable from the latching element by a disengaging lever; a safety lever is coordinated to the latching pawl for purposes of blocking its disengaging movement or interrupting its connection while a forced locking lever is connected with the safety lever and includes a part following the latching pawl during actuation of the safety lever.

U.S. Pat. No. 3,858,919 purports to teach a motor vehicle door latch wherein a coupling body on the doorpost is lockingly engageably by a pawl on the door edge which, in turn, is blockable by an operating lever. The latch has an actuating member which is operated by the door handles and is connected by a link to the operating lever. The actuating member is formed with a slot in which a pin carried by the locking mechanism is engaged. The operating lever has a guide surface with which the pin is only engageable when the pin is towards one end of the guide slot. Thus when the pin is at the other end of the guide slot the two elements are effectively disconnected and the door cannot be opened by actuation of either of the handles. But should either handle be retained in the actuated position and the locking mechanism be operated to unlock the door, the link will move along in the groove, engage the guide surface on the operating lever, and cam this lever over to free the pawl and operate the lock. This pin may be made of a synthetic resin having a low coefficient of friction such as polytetrafluorethylene.

U.S. Pat. No. 4,334,704 purports to teach an automobile door locking mechanism incorporating a child-lock device which is connected to an actuator lever of the mechanism through idle means and operable to keep the locking mechanism in a locking condition even when a locking knob is released and a door handle or button is manipulated and which allows the door or button to move idly.

U.S. Pat. No. 4,289,342 purports to teach a motor vehicle door lock which comprises a ratchet locking mechanism, being a preferably bolt-shaped catch of which there can engage the flanks of two locking teeth which are arranged one behind the other and which are arranged on a pivotable locking lever which is pressed into the locking position by spring pressure and which, upon a movement of the catch relative to the lever during the locking of the door, can be pivoted by the catch against the spring pressure. For the opening of the lock there engages in the locking lever or is secured thereto, a driving member by means of which the locking lever can be removed from the catch to such an extent that the respective abutting tooth edge becomes disengaged.

U.S. Pat. No. 4,196,925 purports to teach an improved door lock mechanism having an opener plate which can pivot to move a detent to a locking or unlocking position, the detent being able to open or close the door latch. The opener plate is further movable to an activating or non-activating position by a first locking lever connected to a garnish button for movement against a turn-over snap action spring and a second locking lever covering the first locking lever and connected to a key cylinder for movement with the cylinder without lost motion.

U.S. Pat. No. 4,005,887 purports to teach a keyless door locking mechanism for an automotive vehicle comprising a latch member engageable with a striker element on the vehicle body during closing of the door, a detent element engageable with the latch member for keeping the same latch when engaged by the striker, a release element having a shoulder being connectable with the detent for releasing engagement of the latch member and the detent in an unlocked position thereof, a locking lever for moving the release element to a locked position to free the connection of the detent and the release element, a keyless locking lever being moveable with the locking lever between the unlocked and locked positions thereof and being further moveable to a keyless locked position, a cancelling lever moveable with the locking lever between the unlocked and locked positions thereof and further moveable to the keyless locked position and being engageable with the detent to return the locking lever moved to its locked position during door opening to its unlocked position upon door closure, but being disengaged with the detent by the keyless locking lever at the locked position thereof to maintain the locking lever so moved to its locked position during door opening to keylessly lock the door lock mechanism upon door closure, and a manually operable inside rod for moving the keyless locking lever to its locked position independently of the locking lever.

U.S. Pat. No. 4,440,006 purports to teach a central door-lock system having a plurality of door latches each including a detent displaceable between an open position securing the respective door to the respective doorpost and a closed position permitting the respective door to separate from the respective doorpost, a manual door-opening handle, mechanism including a primary latch member connected to the handle and connectable to the detent and moveable between a lock position preventing this handle from displacing the detent between its open and closed positions and an unlock position permitting the handle to displace the detent between the open and closed positions, and a secondary latch member displaceable between a lock position urging the primary latch member into the respective lock position while permitting the primary latch member to move into the respective unlock position, an unlock position permitting the primary latch member to move freely between the respective lock and unlock positions, and an antitheft position positively holding the primary member in the respective lock position. In addition, respective servoactuators for the latches each include an operator linearly displaceable between lock, unlock, and antitheft positions, an actuator element entrainable by the respective operator, connected to the respective secondary latch member, and jointly displaceable therewith between the respective positions, and a reversible electric servomotor and a rack-and-pinion gear train connected between this motor and the respective operator for displacing the respective secondary latch member via the respective actuator element and operator between the respective lock, unlock, and antitheft positions. A central switch is connected to the servomotors for operating same jointly and thereby jointly displacing the secondary latch members between the respective positions.

U.S. Pat. No. 4,494,782 purports to teach a drive device for a locking mechanism of a motor vehicle door lock which can be fastened by means of a central locking installation comprising an operating element which is guided on a housing for linear displacement between a fastening position and an unfastening position and is coupled with the fastening mechanism. A motor drives the operating element in both directions of displacement. A locking lever mounted on the housing for pivoting about a spindle extending transversely of the direction of displacement of the operating element in its locking position blocks the operating element when it is situated in the fastening position. Thus the fastening mechanism in the locked condition cannot be unfastened manually. The locking lever is pivoted by a rotating drive through an eccentric. The eccentric engages in an aperture of the locking lever. The aperture permits a pivoting movement of the eccentric of more than 180°, while a stop face of the aperture limits the range of rotation of the eccentric. The end positions of the eccentric are situated, both in the locking position and in the unlocking position of the locking lever in a "beyond-dead-point position", so that the locking device holds the locking lever in self-locking manner.

U.S. Pat. No. 4,487,441 purports to teach a child-proof door locking device for use with an automotive door which comprises a base plate securely attached to the door, an inside lever pivotally connected to the base plate and pivotally movable in response to handling of the inside handle, an outside lever pivotally connected to the base plate and pivotally movable in response to handling of the outside handle, a first device for causing the latching device to assume its inoperative condition when the outside lever is pivoted in a given direction, a second device for linking the outside lever with the inside lever so that pivoting of the inside lever in a given direction induces the pivoting of the outside lever in the given direction, and a child-proof lever pivotally connected to the base plate and disengaging the second device from the inside lever when assuming its child-proof position.

Canadian Letters Patent 1,128,094 purports to teach an automobile door locking mechanism comprising a latch rotatable upon engagement with a striker, a ratchet for preventing the rotation of the latch in the direction for releasing its engagement with the striker, an actuator plate for releasing the engagement of the ratchet with the latch, connecting means for effecting and releasing the engagement of the actuator plate with the ratchet, and a rotary lever operable to actuate the actuator plate in response to operation of an interior door handle, in which another lever is pivotally fitted to a shaft which pivotally locates the rotary lever, one of said levers being formed with a slot opening which extends radially with respect to the shaft and the other being formed with a slot opening having an idle opening which extends circumferentially with respect to the shaft, and a connector means having a part which passes through the slot openings at a right angle to the plane of rotation of the levers, said connector means being connected to a child lock change lever so as to slidingly change its location within the slot openings and said another lever being connected to the interior door handle, whereby to determine whether actuation of the actuator plate is possible in response to operation of said handle.

As is apparent, the said mechanism are complex in their use, manufacture, assembly and/or operation. It is also clear from the substantial number of parts in each mechanism that each of the mechanisms' weight and size (particularly each of their thicknesses or depths) is substantially increased.

See also U.S. Pat. Nos. 1,512,141; 2,118,729; 3,525,545; 3,904,230; 4,289,342 and 4,312,527 relating to other aspects of the structural portions of latches and their operation.

It is therefore an object of this invention to provide an improved operator mechanism suitable for use in a door latch mechanism or individually housed for use for operating structural portions of a door latch.

It is a further object of the invention to provide such a mechanism with a minimum number of parts, and thus minimum weight and thickness.

It is a further object of the invention to provide a compact mechanism easily manufactured and simple to assemble having versatility in use.

It is still a further object of the invention to provide such mechanism at minimum cost.

It is a further object of this invention to permit the improved operator mechanism to be incorporated into a module which may then be secured to other components (for example structural components) or with the structural components in the same module.

Further and other objects of the invention will be realized by those skilled in the art from the following summary of the invention and detailed description of embodiments thereof.

SUMMARY OF THE INVENTION

According to one aspect of the invention, an operating mechanism suitable for use in a door latch mechanism (for example, comprising structural components such as a pawl and ratchet) of a door of a vehicle is provided, the operated mechanism comprising:

(a) an inside handle release lever for being operated from the inside of the door, for example by the operation of an inside door handle;

(b) an outside handle release lever for being operated from the outside of the door, for example by the operation of an outside door handle;

(c) means for being engaged by the inside handle release lever and outside handle release lever, said means being connected to release the structural components of the latch for operation (for example, release the pawl);

(d) at least one of said inside handle release lever and outside handle release lever (and preferably at least the outside handle lever) being movable to a position whereat the release lever cannot engage said means to release the structural components when operated.

Preferably, the operation of the inside handle release lever and outside handle release lever directly operates said means (as opposed to indirect operation through other components). In one embodiment, each release lever carries a shoulder for engaging said means. In another embodiment, only one lever carries a shoulder for such engagement and the other lever is rotatable in and out of engagement with said means.

Preferably, at least one of the release levers slides longitudinally to engage said means and is pivotable (about a pivot) so that longitudinal sliding movement of the release lever when the release lever has been pivoted, does not permit the release lever to engage said means.

According to another aspect of the invention, both release levers may be slideable to engage said means and may be pivotable to positions which will not permit engagement by said release levers with said means. With respect thereto, in one embodiment a longitudinally extending slot is provided in each lever. In this embodiment the release levers overlie one another and are supported on a pin for limited sliding longitudinal movement with respect thereto. The levers are spring biased towards one another and a rotatable cam lever or locking lever is provided to rotate the inside handle release lever, the outside handle release lever and/or both levers out of their normal position against the action of the spring so that longitudinal sliding movement will not permit engagement with said means.

According to another aspect of the invention, the inside handle release lever may not be moved to a position to be unable to engage said means. Thus, the outside handle release lever is the only release lever so moveable. In this regard, the outside handle release lever may have a longitudinally extending slot in which a pin is carried on which it may pivot by the cam lever or locking lever.

According to another aspect of the invention, the inside handle release lever is rotatable about a pivot point (preferably in a plane at right angles to the plane of movement of the outside handle release lever) and said outside handle lever is slideable longitudinally to engage said means and is pivotable to a position whereat slideable movement will not permit engagement of said means.

In one embodiment, said means comprises an arm rotatable about a central pivot, the rotation thereof releasing the structural components of the latch for operation, one end of the arm for engagement by the inside handle release lever and the other end for being engaged by the outside handle release lever. In some embodiments with this construction, a cam arm or locking lever is provided and rotated by the inside handle release lever to position the outside handle release lever in a position whereat it cannot engage said means. In one embodiment, a pin secured to the end of the cam arm for operating the outside handle release lever is supported in a longitudinal slot in the outside handle lever. Thus, rotation of the cam arm rotates the outside handle release lever out of position so that slideable longitudinal movement thereof will not engage said means.

According to another aspect of the invention, the inside handle release lever may carry an elongated slot and is supported on a pin for slideable longitudinal movement. According to an embodiment, it is pivotable about the pin to a position whereat it cannot engage said means.

According to another aspect of the invention, the inside handle release lever may be rotatable in a plane at right angles to the plane in which the motion of the outside handle release lever occurs.

According to another aspect of the invention, said means being connected to release the structural components of the latch comprises a pin moveable (either slides or rotates) to release the components (for example, the pawl and thus the ratchet).

According to another aspect of the invention, said means to release the structural components of the latch comprises an arm or release lever that rotates causing release of the structural components (for example, the pawl and ratchet).

This invention permits all the necessary functions of a door latch to be provided with a reduced number of parts. The actual number of components for the operating mechanism constructed according to the invention will vary depending upon the actual design utilized. It will, of course, be appreciated that the number of parts does not include the structural components (for example, pawl and ratchet), as the structural components are not part of the invention, though the invention may be utilized with such structural components.

The latch functions that may be achieved are as follows:

(a) inside release;

(b) outside release;

(c) locking.

Optional functions that can be provided are:

(d) override;

(e) child proof lock (usually in rear door only);

(f) anti-lockout (usually driver's door).

Additionally, the key cylinder (in the front doors, for example) may be attached to the cam arm or locking lever to operate the outside handle release lever to rotate the lever between positions whereat the lever when moved longitudinally will or will not engage the means being connected to release the structural components.

Still further, the inside handle of a door may be connected by a single cable (Bowden cable) to rotate the inside handle release lever (and return the lever to its original position) to move the outside handle release lever to a position whereat slideable longitudinal movement of the outside handle release lever will engage the means being connected to release the structural components (if the outside handle is not in that position) and thereafter engage the arm rotatable about a central pivot (the means being connected to release the structural components) to cause release of the structural components (for example, pawl and ratchet) to release the door for opening.

The inside handle may have associated with the handle and its operation, a handle lock lever which pivots like the handle towards and away from the door (and in the same direction as the handle when the door is to be opened). In this regard, the handle lock lever is operable by the handle to operate with the handle when the door is to be opened. The handle lock lever when either depressed or raised, causes the outside handle release lever to be moved to a position whereat it does not engage the means (for example, the arm) to release the structural components. In this regard, the inside handle release lever may be forked, one space between one set of forks for positioning the arm (means therebetween for releasing the structural components) and another space for receiving the end of the cam arm or locking lever. When the inside handle is pulled or depressed to open the door, the arm is first caused to move the outside handle release lever to the position to engage the means to release the structural components if moved longitudinally and then the inside handle release lever engages the means to release the structural components.

According to another aspect of the invention, an operating mechanism for operating the structural components of a door latch mechanism is provided, the operating mechanism comprising a pair of release levers, at least one release lever, preferably both release levers, carrying a longitudinal slot for being supported (by means of the longitudinal slot) on a pin (the pin preferably being connected to a wall of a housing for supporting the at least one lever), the said at least one release lever carrying a shoulder (and preferably both levers each carrying a shoulder on the side of each lever closest to the other lever), the levers for being connected to the inside door handle and the outside door handle for permitting opening of the car door, and means to be engaged by the levers for operating the structural components of the lock, at least one of the levers being moveable to a position whereat it cannot engage said means. For example, where the two release levers each carry a shoulder and slot, the two levers are spring biased towards one another and a locking lever (cam) is provided between the two and carries cam surfaces thereon, so that when the release levers are in their normally spaced position, the shoulders of each are aligned with the means (for example, a pin secured to the structural components) so that longitudinal movement of one of the levers towards the pin permits engagement of the shoulder with said means attached to the structural components releasing for example, the pawl and thus the ratchet, unlocking the door and whereby when the cam surfaces on the locking lever (cam) is moved to different positions the levers swing further from one another so that longitudinal movement of at least one of the levers will not engage said means connected to the structural parts until the locking lever is returned to the normal position releasing the at least one release lever to be spring biased towards the other release lever to their normal engaging positions aligned with said means (for example, pin) secured to the structural parts of the door latch mechanism.

According to another aspect of the invention, a door latch mechanism is provided comprising the operating mechanism described above and a ratchet and a pawl (structural components) in a plastic modular case for assembly into a vehicle door, said means being connected to operate the pawl and ratchet to unlock the vehicle door.

BRIEF DESCRIPTION OF THE DRAWINGS

The invention will now be illustrated with reference to embodiments of the invention shown in the accompanying figures in which.

DETAILED DESCRIPTION OF THE EMBODIMENTS

Figure 1:
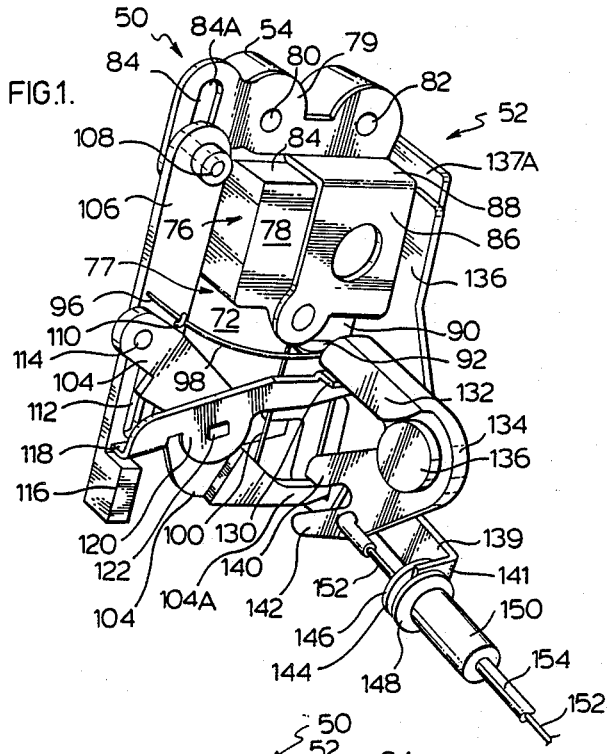
FIG. 1 is a perspective view of a door latch mechanism incorporating an operating mechanism according to one embodiment of the invention.
Figure 2:
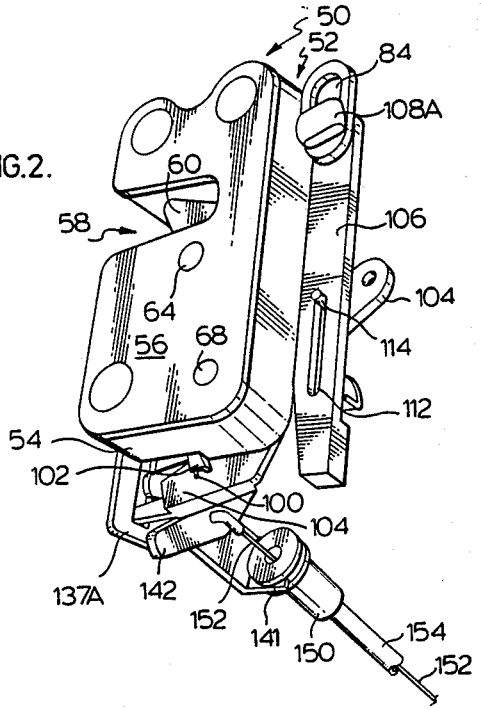
FIG. 2 is a view of the mechanism of FIG. 1 looking from the opposite direction.
Figure 7:
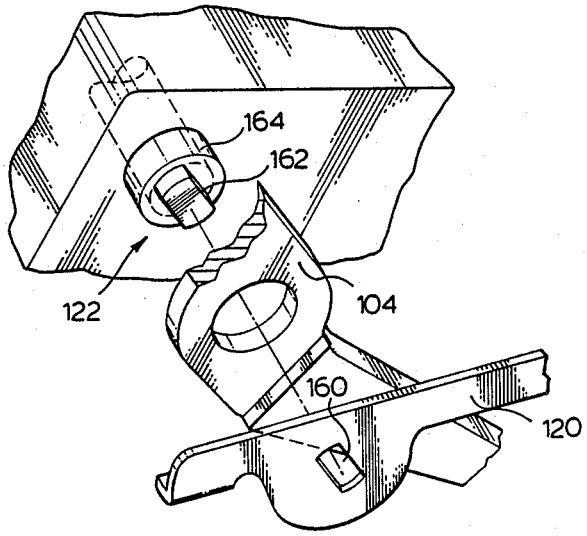
FIG. 7 (found with FIG. 5) is a close-up perspective exploded view of part of the structure shown in FIG. 1.
Figure 6:
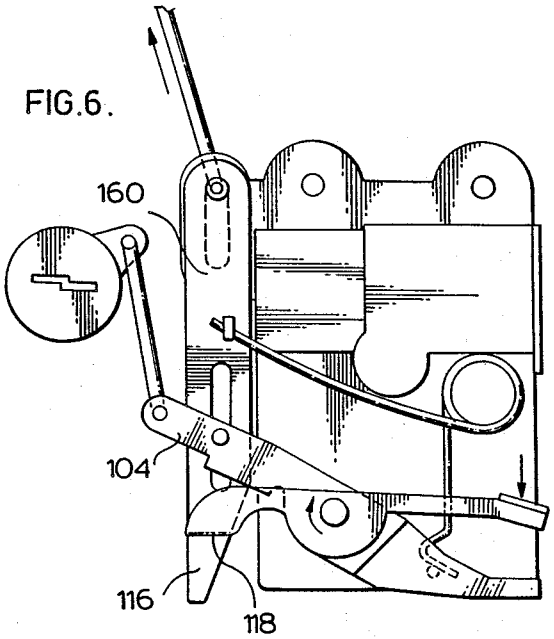
Figure 7A:
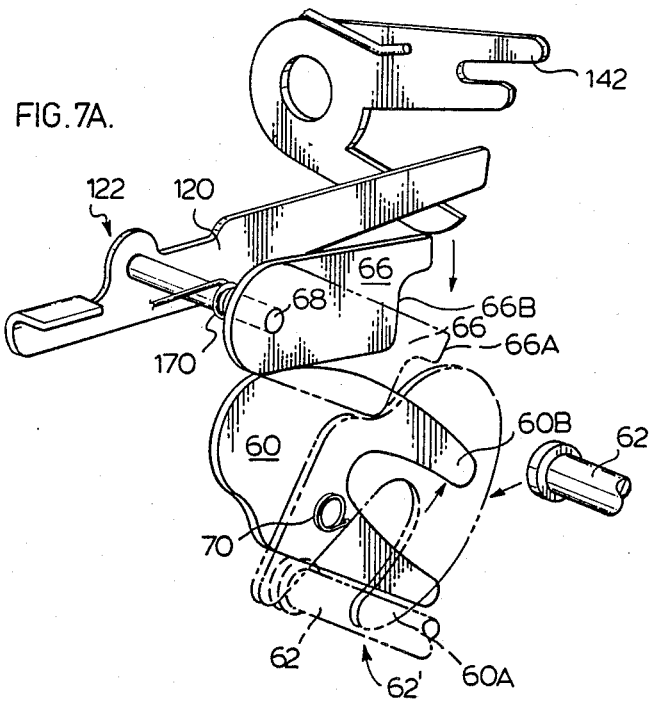
FIG. 7A is a perspective view of some of the components shown in FIG. 1 connected to the structural components (pawl and ratchet) of the lock mechanism shown in FIG. 1.

With reference to FIGS. 1 and 2, there is shown latch mechanism 50 (about 2½ cm thickness) comprising injection moulded body portion 52 comprising generally rectangular part 54 covered by back cover 56 and presenting a slot or mouth 58 into which ratchet 60 projects (see also FIG. 7A) for being engaged by striker 62 (see FIG. 7A). Ratchet 60 is mounted to pivot on pin 64 and is held in position after it has received pawl 62 as at 62' shown in FIG. 7A by pawl 66 which is pivoted on pin 68 (see FIG. 7A) so that when pawl 66 is moved from position 66A to position 66B shown in FIG. 7A, ratchet 60 is free to release striker 62 and is urged by torsion spring 70 to rotate from position 60A where it captures striker 62 to position 60B (see FIG. 7A). With respect to FIG. 2, ratchet is in the position shown as 60B in FIG. 7A.

Figure 3:
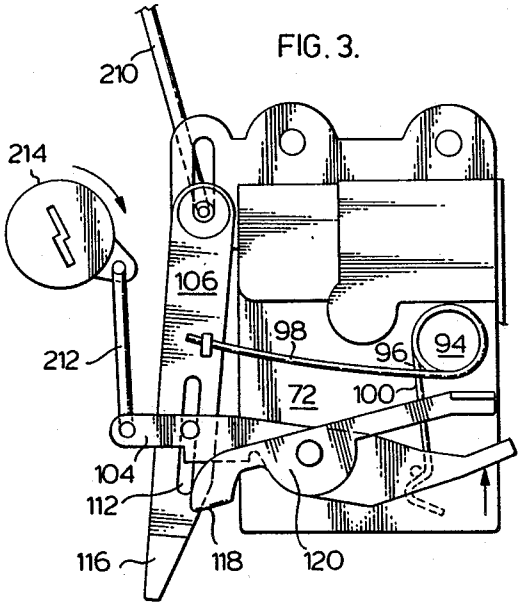
Figure 5:
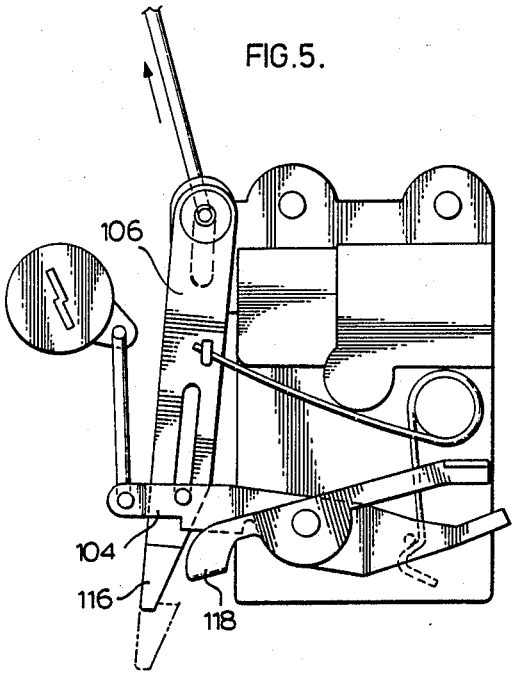

The other side of rectangular part 54 comprises face 72 and a raised block portion 76 comprising face 78 spaced from face 72. A metal plate 79 is secured to the face of part 54, as shown in FIG. 1, by pins 80 and 82 and carries slot 84. Plate 79 also carries L-shaped metal portion for engaging face 78 by portion 86 and side 74 by L-shaped connector portion 88. Face portion 86 carries an L-shaped portion which extends from the side thereof remote side 88 and engages the other side 77 of raised block portion 76. Tab 90 extends from portion 77 along face 72 and is curved at 92. A raised annular boss 94 extends upwardly from face 72 (see FIG. 3) for receiving torsion spring 96, one arm 98 of which extends laterally and the other arm 100 extends generally downwardly and is anchored by tab 102 in cam lever (or locking lever) 104. Inside handle release lever 106 carries a pin 108 which projects through slot 84 and is covered by cap 108A to lock pin 108 in slot 84 for movement therein. Arm 98 of spring 96 is secured by tab 110 to inside release lever 106 and urges release lever to be moved so that pin 108 is at the end of slot 84 nearest spring arm 98. Arm 106 also includes a longitudinally extending slot 112 for receiving pin 114 of cam or lock lever 104 to permit sliding movement of locking lever 104 relative to lever 106. Lever 106 carries raised portion 116 which is aligned with tab 118 of metal pawl lever 120 secured to pivot on pin 122 (on which cam or lock lever 104 is also pivoted to rotate). (In this regard see FIG. 7.) Thus when lever 104 rotates, arm 106 is pivoted about pin 108 in slot 84 to be raised and lowered. When arm 104 is in the position shown in FIG. 1, projection 116 is aligned with tab 118 of pawl arm 120. When arm 104 is in the position shown in FIGS. 3 and 5, projection 116 is not aligned with tab 118 and thus if arm 106 is retracted in slot 84 towards the rear 84A of slot 84, projection 116 will not engage tab 118.

Tab 130 located at the end of pawl arm 120 opposite tab 118 is meant to be engaged by arm 132 of inside handle release lever 134 pivotally secured by pin 136 to a metal plate 137 connected to plate portion 86. Lever 134 is oriented to rotate in a plane at right angles to the plane of lever 106. Lever 134 is forked and comprises arms 132 for engaging tab 130 of pawl lever 120 and arms 140 and 142 for engaging end 104A of arm 104 therebetween to cause arm 104 to be pivoted clockwise or counterclockwise as arm 134 pivots either clockwise or counterclockwise. Metal plate portion 137 sits on ledge 137A forming part of body 54. Plate 137 also contains metal support portion 139 carrying upstanding flange 141 having a curved slot opening for insertion into slot 144 provided between raised and spaced flanges 146 and 148 of connector 150. Wire 152 covered by sheath 154, (as for example being a Bowden cable) extends through connector 150 and is connected to arm 142 of inside handle release lever 134.

With reference to FIGS. 7 and 7A, pawl lever 120 carries rectangular slot 160 therethrough for receiving rectangular portion 162 on the end of pin 122 and the two portions are welded together. Thus, pawl lever 120 rotates with pin 162 because of the connection. Pin 162 also contains a circular portion 164 on which lock lever 104 is fixed to rotate, however, lock lever 104, because of the circular configuration about portion 164, will not be caused to rotate when pin 122 is rotated but is adapted to rotate about, or pivot about, portion 164.

With reference to FIG. 7A, pin 122 is urged to be in one position by torsion spring 170 fixed to pawl 66 so that when pawl 66 is moved to the position 66B and released, spring 170 will rotate pawl to position 66A when ratchet is in position 60A.

Figure 7B:
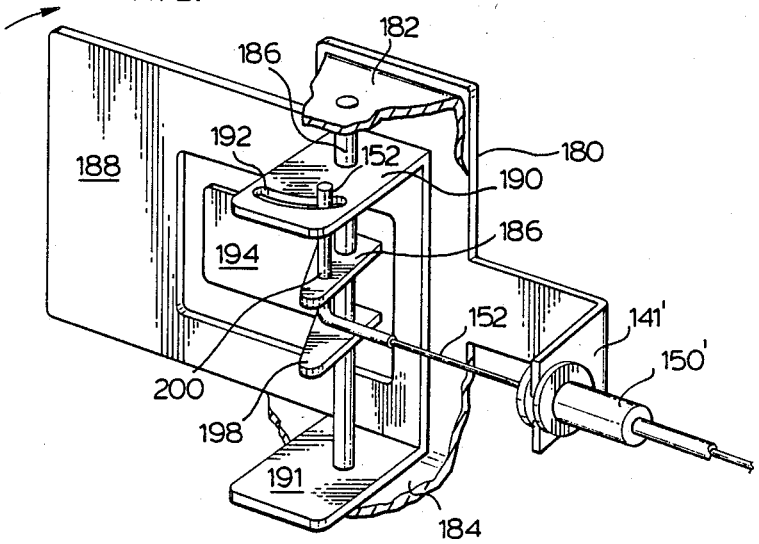
FIG. 7B illustrates a handle mechanism suitable for use to be connected to the mechanism shown in FIG. 1.
Figure 7C:
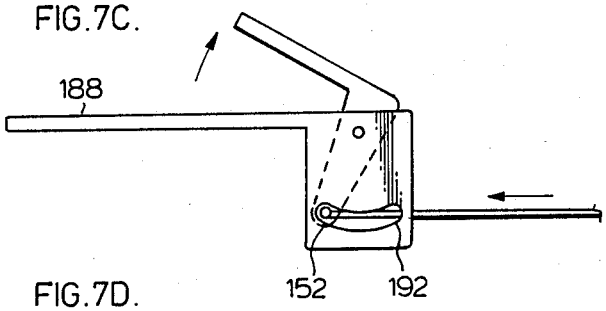
FIGS. 7C, 7D, 7E and 7F illustrate the various positions of the components of the handle mechanism of FIG. 7B when used to operate the lock mechanism shown in FIG. 1.
Figure 7D:
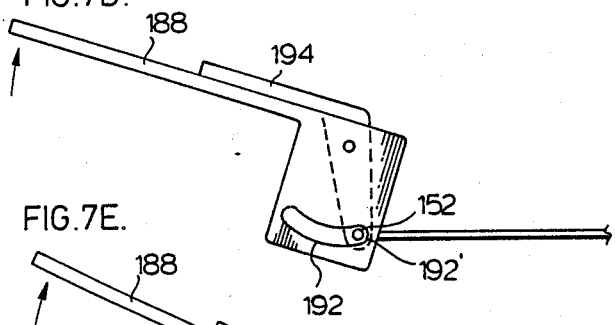
Figure 7E:
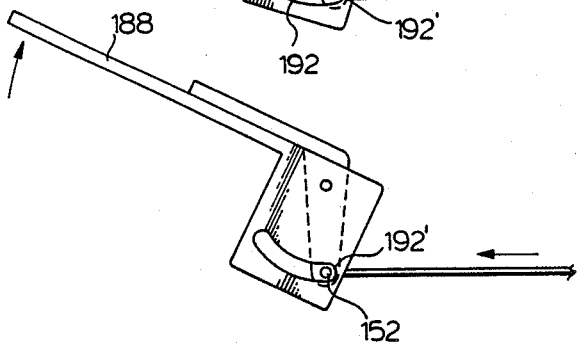
Figure 7F:
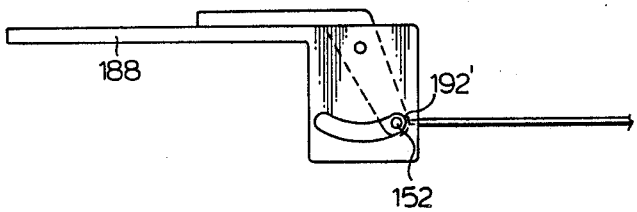

With reference to FIG. 7B, the end of wire 152 is connected at its one other end remote arm 142 to inside handle assembly located on the inside of the car door (not shown) through connector 150' secured in slot in tab 141' supported on handle housing 180. Handle housing 180 comprises opposite extending flanges 182 and 184 through which pin 186 passes. Handle 188 is secured to rotate on pin 186 and comprises depending flanges 190 and 191 extending from handle 188. Flange 190 carries a curved slot 192. Supported on pin 186 by flanges 196 and 198 is lock handle or lock button 194. Flange 196 also carries depending aperture 200 for passing wire 152 therethrough to be passed through slot 192 of depending flange 190. Rotation of handle 188 in the direction of the arrow (depending on the positioning of wire 152 in slot 192) will either immediately cause the wire 152 to be drawn rearwardly away from connector 150' or after an interval to do so. See FIGS. 7C through 7F inclusive.

With reference to FIGS. 3, 4, 5 and 6, the operation of mechanism 50 will be illustrated. Lever 106 is connected to the handle on the outside of the door by rod or wire 210 and arm 104 is connected via rod or wire 212 to key lock 214. As is illustrated with reference to FIGS. 3 and 4, the rotation of key lock from the position shown in FIG. 4 to the position shown in FIG. 3 causes wire 212 to push the end of lock lever 104 towards projection 116 on lever 106 raising projection 116 out of alignment with tab 118 of pawl lever 120. Pulling on outside handle (not shown) causing wire 220 to pull pin 108 to the end of slot 84 shown in FIG. 5 when the key lock is in the position shown in FIG. 5 causes the pulling of arm 106 rearwardly *not* to engage tab 118 of pawl lever 120.

Figure 4:
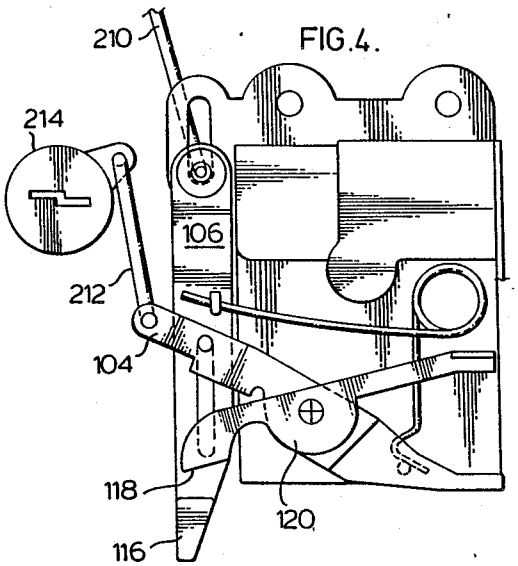
FIGS. 3, 4, 5 and 6 (shown with FIGS. 8 and 9) illustrate the operation of part of the mechanism shown in FIGS. 1 and 2 also comprising a key cylinder.

However, when key lock is turned to the position shown in FIG. 4 with the pin 114 of lock lever or cam lever 104 in the position shown in FIG. 4, the pulling of the outside handle by the pulling of rod or wire 210, will pull pin 108 rearwardly to the rear of slot 84, and then pull projection 116 to engage tab 118 rotating pawl lever 120 causing the pawl 66 to be pivoted to position 66B releasing ratchet 60 to move with the action of torsion spring 70 to the position shown as 60B shown in FIG. 7A releasing striker 62. When projection 116 of lever 106 cannot engage tab 118 of pawl lever 120, the outside handle connected to wire 210 is inoperative and the door is locked. The door may be opened by unlocking the key lock 214 or by operating the inside handle shown in FIG. 7B.

Figure 9:
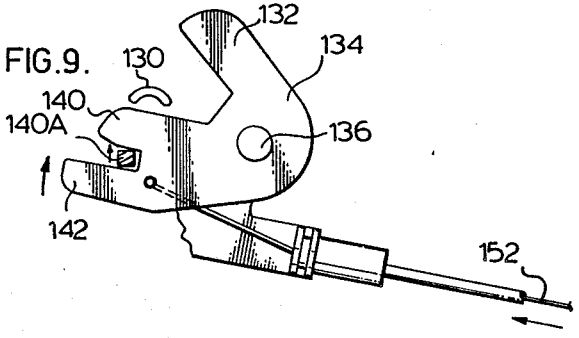
FIGS. 8 and 9 (found with FIG. 6) illustrate the operation of some of the components shown in FIG. 1.
Figure 8:
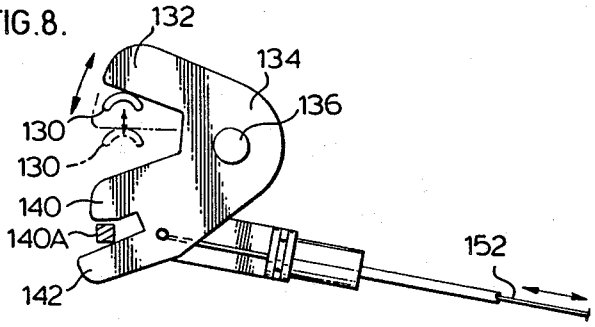

In this regard, with reference to FIGS. 7C through 7F inclusive, FIGS. 8 and 9 and FIG. 1 with lever 104 shown in the position shown in FIG. 1, handle portion or button portion 194 may be depressed which causes wire 152 to be pushed inwardly within sheath 154 causing arm 142 of fork portion 142, 140 to push arm 104A laterally causing lever 104 to rotate about portion 164 of pin 122 causing lever 106 to be raised, thus taking projection 116 out of alignment with tab portion 118. In this regard, the end of wire 152 is moved to the end of slot 192 closest connector 150 (see FIG. 7F). Thus, the outside handle is inoperative. For unlocking the outside handle, handle or button portion 194 is raised as in FIG. 7C drawing wire 152 to the end of slot 192 closest handle 188 thus returning lever 104 to the position shown in FIG. 1 thus "unlocking" the door or rendering the outside handle operative because wire 152 is drawn towards handle 188 thus pulling arm 142 and arm 140 to cause arm 142 to engage arm 104A of lever 104 and rotate it about pin 122 as inside handle release lever 134 pivots about pin 136. Pawl lever 120 is normally in the position shown in FIG. 1 as a result of spring 170 causing it to be in that position. When arm 132 is rotated away from tab 130, arm 140 does not engage tab 130 to push it in any direction. Thus, the space between arms 132 and 140 is such that only arm 132 acts on tab 130 of pawl lever 120 pushing it towards arm 140 but not the other way. Pawl lever 120 after tab 130 is pushed towards art 140 and arm 132 is moved back to the position shown in FIG. 1 is returned to the position in FIG. 1 by the action of spring 170. In this regard see FIGS. 8 and 9.

When it is desired to open the door employing the inside handle 188 irrespective of whether the outside handle is inoperative or operative, handle 188 is raised (see FIG. 7D) causing wire 152 to engage the portion of slot 192 (nearest latch mechanism 50) at 192' thus pulling the end of wire 152 causing arm 132 of inside handle release lever 134 to engage tab 130 rotating pawl lever 120 and thus pin 122 (see FIGS. 7 and 7A) against the action of spring 170 raising pawl 66 to the position 66B permitting ratchet 60 to rotate by the action of torsion spring 70 to the position shown at 60B releasing striker 62.

With reference to FIGS. 1 through 9 inclusive, the outside handle release lever 106 was slideable longitudinally of its length to engage the pawl lever 120 by engaging tab 118 for the release of the striker 62 from the ratchet 60 and can be pivoted to a position where lever 106 cannot engage the pawl lever. The inside handle release lever, however, does not move in the same manner, but is rotated in a plane at right angles to the plane of motion of the outside handle release lever 106.

Figure 10:
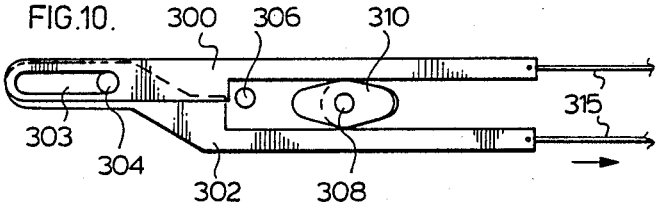
FIGS. 10 to 13, inclusive, illustrate schematically another embodiment of the invention and its operation.
Figure 11:
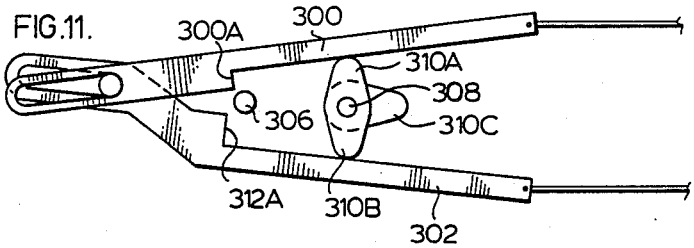
Figure 12:
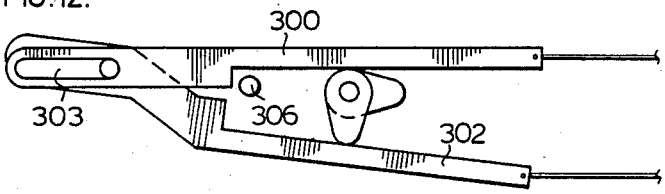
Figure 13:
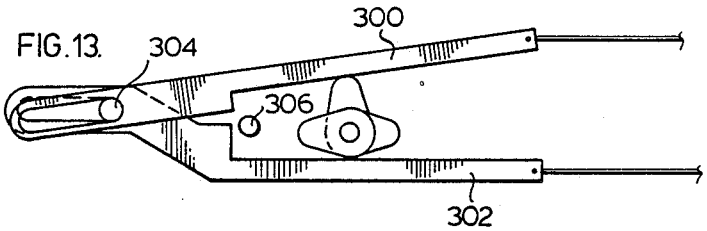

With reference to FIGS. 10 through 13 essentials of an operating mechanism according to an embodiment of the invention are illustrated schematically. In this regard an outside handle release lever 302 and an inside handle release lever 300 are provided and are each slidable longitudinally to engage pin 306 which when engaged (either moves longitudinally or rotates) causing the rotation of a pawl (not shown) to permit the release of a striker (not shown) by a ratchet (not shown) of the structural components of a lock mechanism. FIGS. 10 to 13 also illustrate the use cam assembly 310 to bias the levers away from one another under certain conditions so that shoulders 302A and 300A on the release levers are moved out of alignment with pin 306. Thus, inside handle release lever 300 and outside handle release lever 302 are provided each carrying a shoulder 300A and 302A respectively for engaging pawl pin 306 connected to the pawl (not shown) which operates to cause the ratchet to release the striker (not shown). Each of levers 300 and 302 carries a slot 303 in which is supported pin 304. Lever 300 overlies lever 302. Cam assembly is positioned between release levers 300 and 302. Cam assembly rotates about pin 308 and comprises cam bodies 310A, 310B, and 310C. By positioning the cams appropriately to space lever 300 and 302 out of alignment of shoulder 300A and 302A with pawl pin 306 or into alignment with pawl pin 306, the release levers can be positioned (i) as shown in FIG. 10, wherein both the outside handle and the inside handle are operative;

(ii) as shown FIG. 11 where both handles are inoperative;

(iii) as shown in FIG. 12 where the inside handle is operative and the outside handle is inoperative (locked); and (iv) as shown in FIG. 13 where the outside handle is and thus unlocked and the inside handle is locked and cannot be unlocked making it "child proof".

For activation of each of the handles, wires 315 are connected to the release levers and the inside handle or outside handle (not shown). Thus, by pulling on the outside handle for example when wire 315 is pulled, release lever 302 is pulled and moves forwardly on pin 304 so that shoulder 302 a can engage pin 306 as in FIGS. 10 and 13 but not in FIGS. 11 and 12.

Use of the embodiment of the invention shown in FIGS. 10 to 13 is made in further embodiments illustrated in FIGS. 14 to 26 inclusive, FIGS. 27 and 28 and FIGS. 29 to 34 inclusive.

With reference to FIGS. 14 to 26 inclusive there is shown latch mechanism 400 connected to be operated by outside handle 402 and inside handle 404 and lock button 406. Mechanism 400 is connected to lock button 406 through wire 408 which is covered by a sheath 410 (see FIG. 14) through link arm 412. Mechanism 400 is connected to inside handle 404 through cable or wire 414 covered by sheath 416 (see FIG. 15). Outside handle 402 is carried on the outside of the door 420 of automobile 422 (see FIG. 14) and is rotatable to cause spring loaded arm 424 (see FIG. 15) to depressed in slot 426 by the engagement of tab 428 (see FIG. 23).

Figure 15:
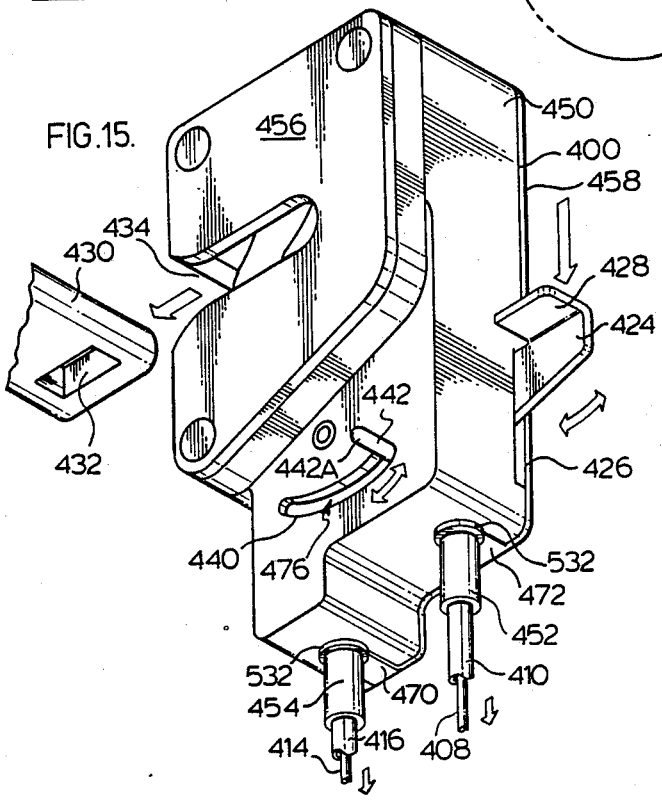
FIG. 15 is a perspective view of a module of the latch mechanism shown in FIG. 14.

Lock mechanism 400 is housed in a casing which is 3 ½ cm thick and is substantially rectangular and carries the operating mechanism for operating the structural mechanism used to engage and secure striker 430 (see FIG. 15). Striker contains retangular opening 432 therethrough.

With reference to FIGS. 15, 17, 18 and 19, slot opening 434 is provided in mechanism 400 into which striker 430 is guided for engagement with ratchet 436 controlled by pawl 438 both of which are spring loaded. As striker 430 is guided into slot 434 it engages ratchet 436 which pivots against the action of a torsion spring about pivot 439 causing pawl 438 to take up the position shown in FIG. 18 and with arm 436A passing through slot 432 into the position shown in FIG. 18.

Outside handle 402 which engages lever 424 at 428 may be constructed and positioned with respect to mechanism 400 to engage the opposite end of lever 424 on the extension 428A of lever 424 shown in dotted line (see FIG. 23) instead of tab 428. (Lever 424 may be similarly constructed to lever 624 shown in FIG. 29.) Mechanism 400 also carries a curved slot 440 through its outer surface of the case for the projection therethrough of child proof locking lever 442 which is free to rotate from one end of the slot to the other.

Mechanism 400 is housed in a case, body portions of which are injection moulded plastics material while the outer covers on the sides are metal plates. For example, body 450 (see FIG. 16) is injection moulded to provide all of the slots cavities and formed portions to which may then be secured different stems or pins threaded into apertures in the casing, different openings for receiving the different connectors (as for example connectors 452 and 454 connecting wires 408 and 414 to the interior of the case). Body 452 is covered by metal plates, plate 456 covering the pawl and ratchet (structural locking components) and metal plate 458 which covers the operating components shown in FIG. 16. In this regard, injection moulded case 450 comprises a cavity 460 surrounded by flanges 462, 464, 466, and 468. Flange 464 carries two slots 470 and 472 for the connecting of wire 408 connected to inside lock button and wire 414 connected to inside handle respectively. Cavity 460 contains a back 474 through which slot 476, aperture 478, and slot 480 are provided. Raised boss 482 is provided raised from surface 474 to receive metal pins 486 (on 482). Pinhead 488 on rivet 484 extends through raised step portion 474A and boss 482 is disposed on recessed surface portion 474B of back 474. Wall 474C spaces surfaces 474A and 474B. Stops 490, 492, and 494 are provided against which elements for example arms of the locking lever (cam) 514 are stopped. Spring slot 496 is provided for receiving spring 498 for being secured to projection 424A. Spring 498 is a compression spring which is constantly urging projection 424A and thus lever 424 towards flange 468.

Three threaded bores are provided in the periphery of case 450 as at 500A, 500B, and 500C to receive bolts for securing metal cover 458 to close cavity 460.

Figure 18:
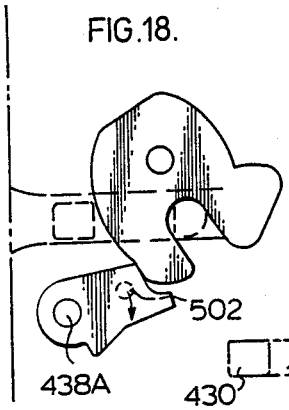
FIGS. 17 and 18 are plan views of the structural components (ratchet and pawl) and their relative operation to secure the striker.
Figure 17:
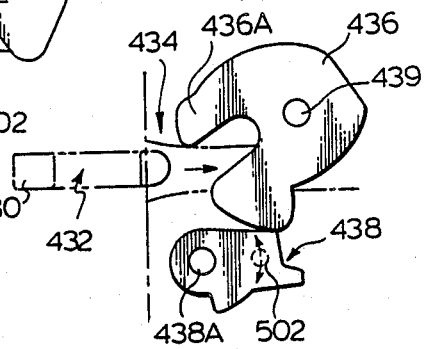
Figure 19:
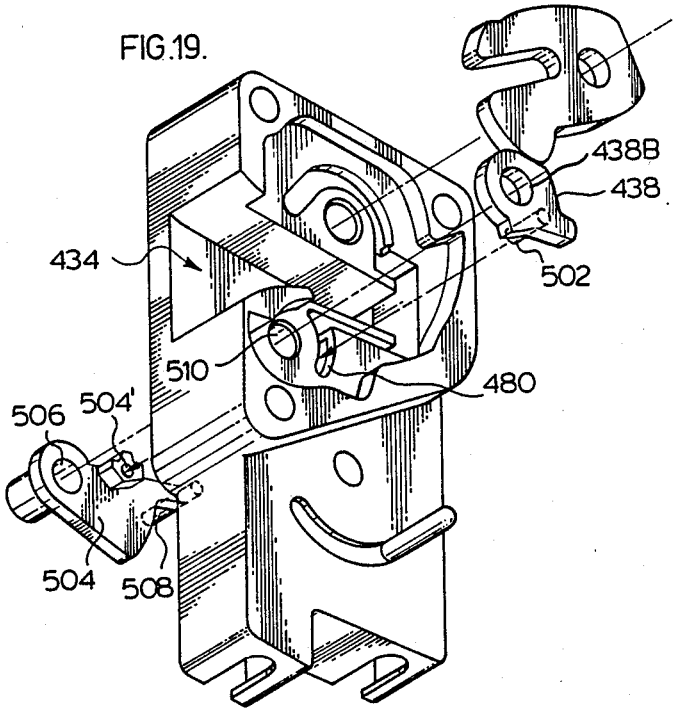
FIG. 19 is a perspective view of part of the latch mechanism shown in FIG. 16 illustrating components thereof.
Figure 21:
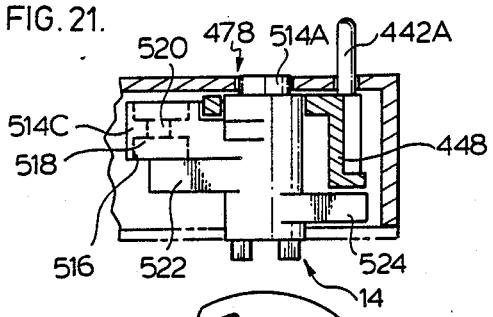
FIG. 21 is the cross-section taken along the line 21-21 in FIG. 20.

With reference to FIGS. 17, 18, and 19, pawl 438 carries on the side closest to cavity wall 474 a pin 502 which rotates about pivot 438A. Pin 502 extends through slot 480 and is received in bore 504' of rotatable arm 504. Arm 504 comprises an injection molded plastic body having cylindrical column 506 at one end and carries on the other end upstanding rod 508. Pin 486 extends through wall 474B through aperture 510 and is secured in bore 438B. To permit pivotting of pawl member 438, pawl 438 is also connected to arm 504 by pin 502. When pawl 438 is rotated so is arm 504. Thus, so is rod 508. If rod 508 is rotated about arm 504, then pawl 438 is also rotated.

Arm 504 carries torsion spring 512 between arm 504 and wall 474B on portion 512A of column 506. One arm of torsion spring 512 abuts locking lever or cam lever 514 which is an injected moulded part and will be described hereafter and the other arm engages inside handle release lever 516.

Childproof locking lever 442 forms part of rod 442A which is connected to annulus 440 having central aperture 446 therethrough. Curved cam surface 448 is provided on the other side of ring 444 for engaging inside handle release lever 516 when the child proof lock is to be engaged.

Cam body 514 comprises a central columnar body. The ends 514A and 514B extend through ring 444 through bore 446. Portion 514A extends through aperture 478 for being secured therein in back wall 474B. The other end of cam body 514 is secured through an aperture in the cover (not shown) of cavity 460.

Arm 514C extends radially from cam body 514 and carries a recess on opposite sides, one of which is shown at 518 and between which aperture 520 opens for receiving and supporting metal end 408A of wire 408 for securing cam body 514 to wire 408. Wire 408 is secured to lock button 406 for the operation thereof. Thus, when wire 408 is either pushed or pulled, arm 514C is caused to rotate and thus cam body 514 is caused to rotate about end 514A carried in aperture 478. Three other arms extend radially from the center thereof, 522, 524, and 526 seen best in FIG. 20.

With respect to torsion spring 512, arm 512A abuts arm 526 of cam 514. As is also apparent from FIG. 16, arm 512B grasps lever 516.

Figure 14:
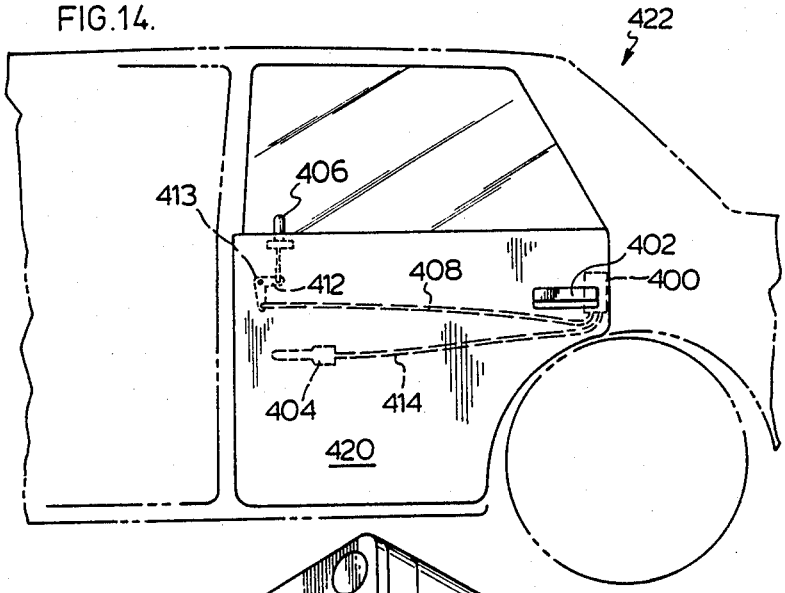
FIG. 14 is a side plan view of part of a car including a rear door incorporating the lock mechanism according to another embodiment of the invention.

Arm 516 carries on the undersurface thereof a bore 528 for receiving end 414A of wire 414 connected to the inside handle release lever 404 (shown in FIG. 14). Release lever 516 and release lever 424 each comprise longitudinally extending elongated slot 530, each slot meant to receive upstanding pinhead and rivet 484 and 488 therethrough to secure levers 516 and 424 through their slots 530 but permit longitudinal sliding movement of the levers as well as pivotting of the levers about pinhead 488 and rivet 484.

Figure 20:
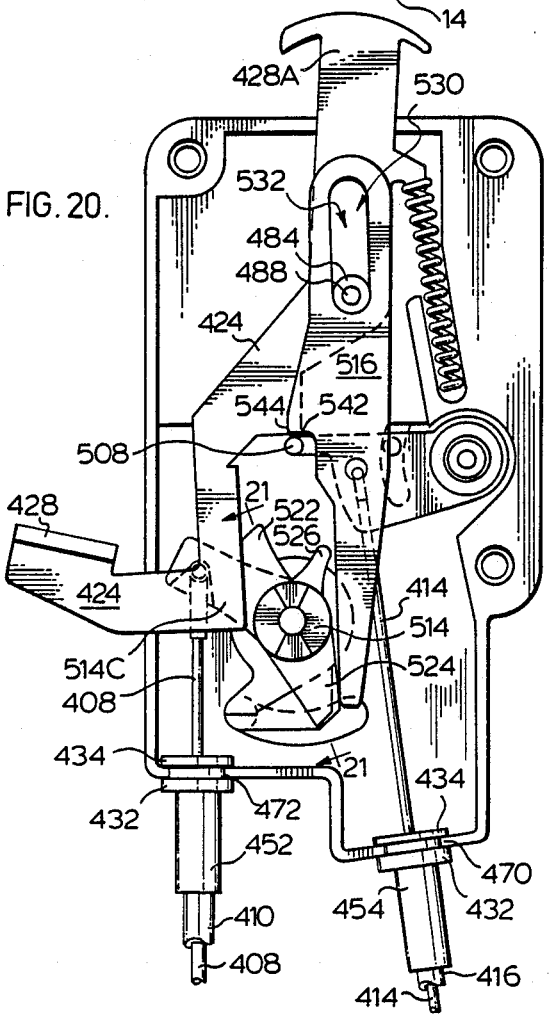
FIG. 20 is a plane view of the relative position of the components shown in FIG. 16 when assembled and in a particular relative position to one another.
Figure 22:
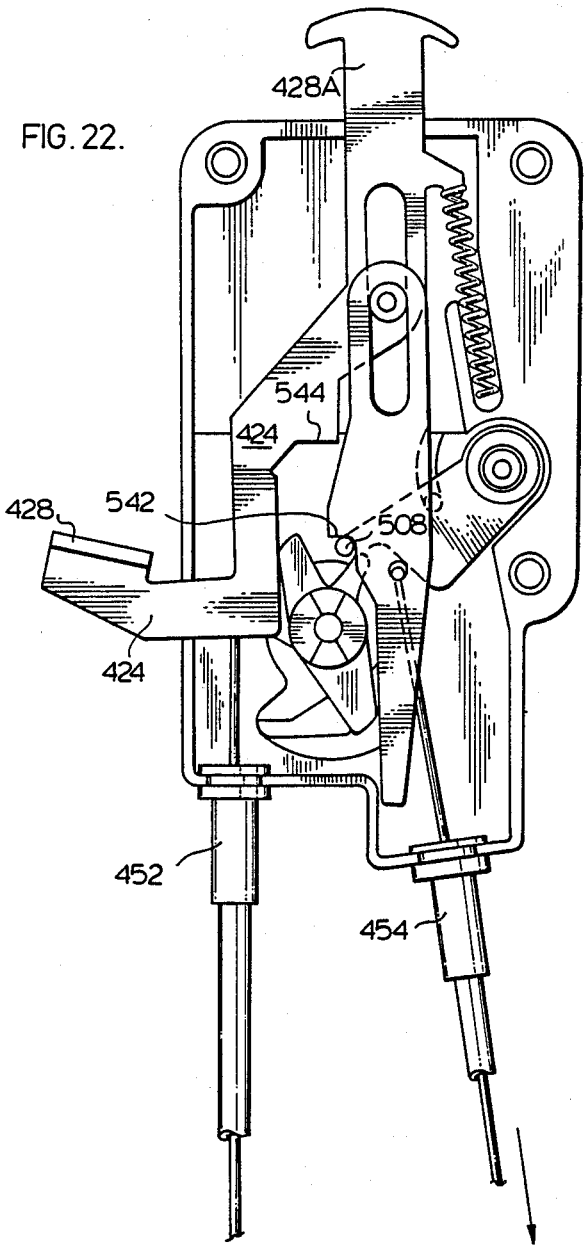
FIGS. 22, 23, 24, 25, and 26 illustrate the components of the latch mechanism shown in FIG. 16 in various positions.

Connectors 454 and 452, each comprise a pair of spaced raised annular flanges 532 and 534 for securing connectors 452 and 454 in slots 472 and 470 respectively by flanges 532 and 534 abutting either side of the peripheral wall portion 464 surrounding each of slots 470 and 472 (see also FIG. 20).

Figure 16:
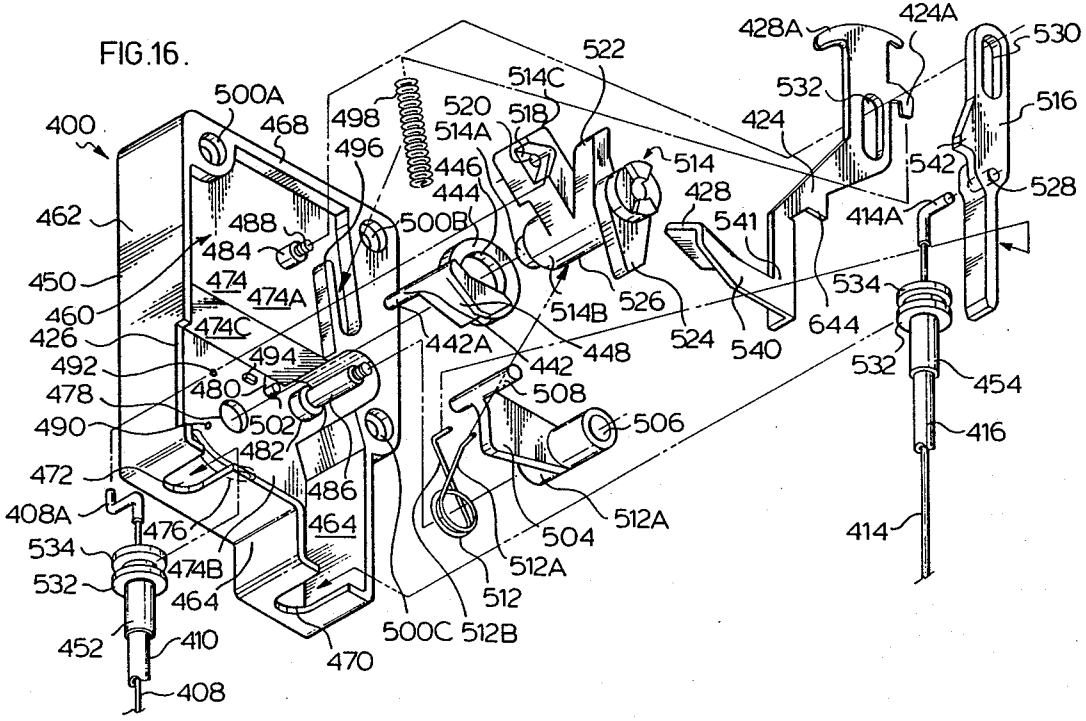
FIG. 16 is a perspective exploded view of the components in the latch mechanism shown in FIG. 15.

The components shown in FIG. 16 are then positioned and connected as shown. With reference to FIGS. 10 to 13 which illustrate schematically the construction and operation of an embodiment, lever 300 is provided for the same purpose as lever 516 shown in FIG. 16, lever 302 for the same purpose as lever 424 and pin 306 for the same purpose as rod 508 forming part of body 504 secured to pawl 438. Cam body 310 is also provided for the same purposes as cam body 514 and child proof lever 442 which employs cam body 448 and pin 442A.

Where flange 428A is provided for engagement by the outside handle 402, portion 540 may be omitted including portion 428 up to dotted line 541 shown in FIG. 16.

When the components are assembled into body 450, lever 516 overlies lever 424. As will be noted, each release lever contains an inwardly directed shoulder, lever 516 carries shoulder 542 and lever 424 carries inwardly directed shoulder 544. When the operating mechanism is assembled, shoulders 542 and 544 are normally aligned with rod 508 so that any longitudinal movement of each of the levers 516 and 524 towards wires 414 will cause the engagement of rod 508. Rod 508 will thus rotate, causing body 504 to rotate about pin 486 against the action of torsion spring 512 which will be wound thus wanting to return to its original position—in this regard see FIG. 20.

With reference to FIG. 20 the unit is at rest with button lock 406 in a position that maintains outside handle operative (unlocked) and the cams on body 514 positioned between levers 424 and 516 so that if handle 424 is rotated by outside handle 402 (see FIG. 23) by the engagement of tab 428, shoulder 544 will engage pin 508 rotating pin 508 causing pawl 502 to be rotated to the position shown in FIG. 17 from the position shown in FIG. 18, permitting the ratchet to rotate caused by the torsion spring (not shown) attached to ratchet 436 to rotate to the position shown in FIG. 17 releasing striker 430, shown also in FIG. 19. (See also FIG. 23.) Similarly the pulling of cable 414 by activation of the inner handle will draw release lever 516 towards it so that shoulder 542 engages pin 508 and the same result occurs. (See FIG. 22.)

Figure 23:
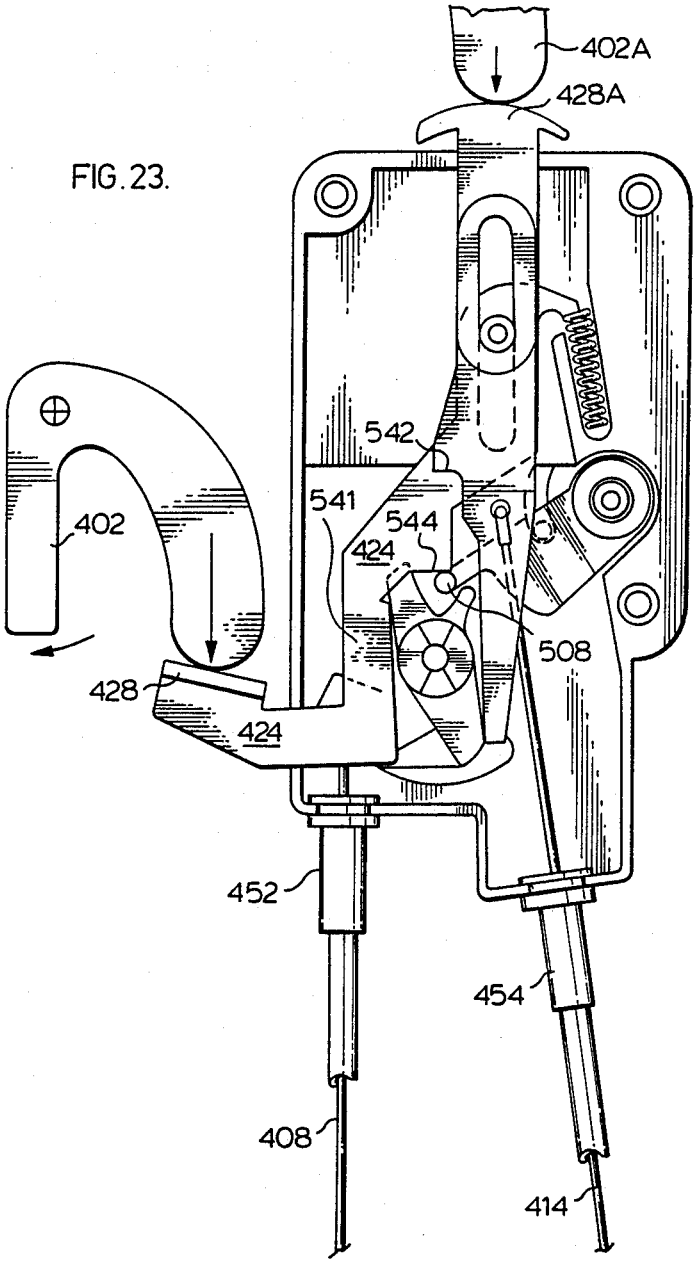

It will be noted that when portion 428 is substituted by portion 428A shown in FIG. 23, the operation of the handle 402A will depress lever 424 (with lever 424 being terminated at line 541) causing shoulder 545 to rotate pin 508.

When it is desired to "lock" the door—in effect rendering the outside handle 402 and the inside handle 404 inoperable, button 406 is depressed rotating arm 412 clockwise about pivot 413 at the elbow of the L-shaped arm 412 (see FIG. 14) pulling wire 408 inwardly towards arm 412 rotating arm 514c causing cam 522 to engage lever 424 with which it is aligned and arm 524 to engage lever 516 with which it is aligned to be pushed apart so that if the outside handle or the inside handle are attempted to be operated thus pulling levers 424 and 516 respectively towards pin 508, pin 508 is not engaged by either of shoulder 544 or 542 and the handles are thus inoperable. (See FIG. 24.)

Figure 24:
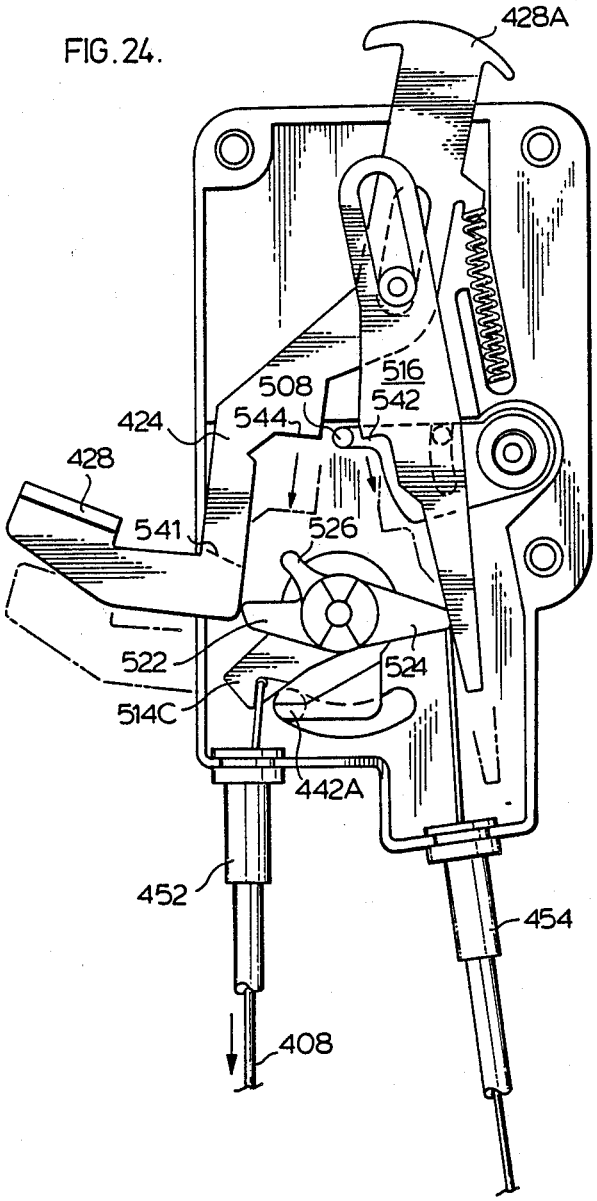
Figure 25:
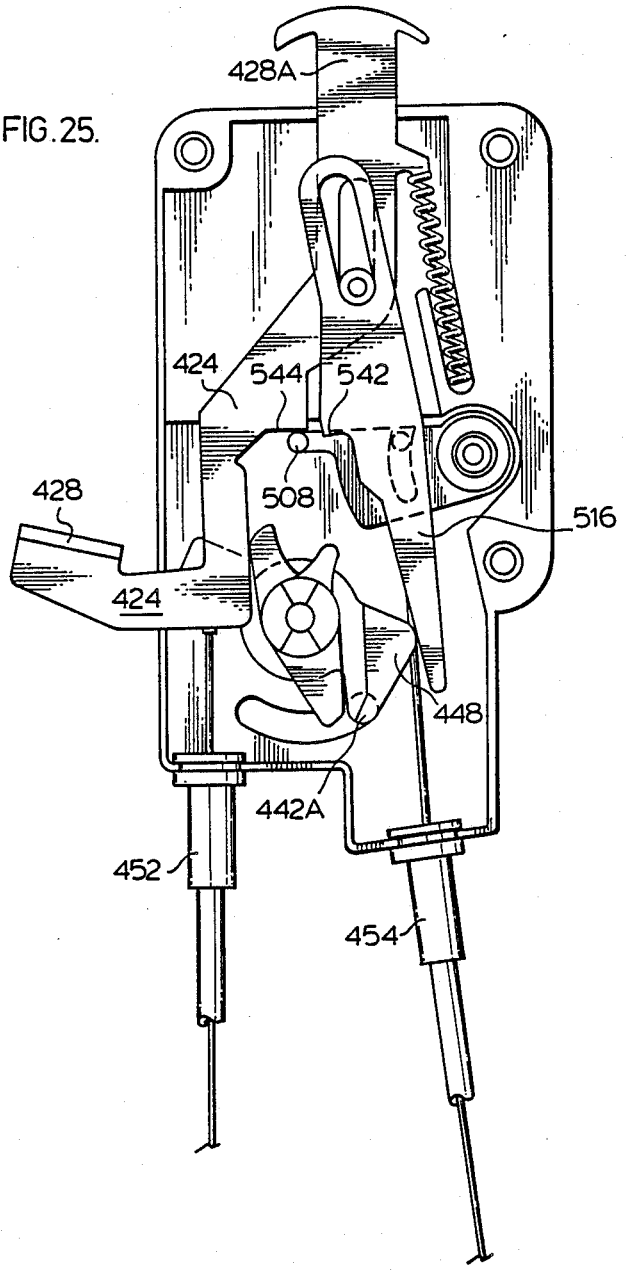

With respect to FIG. 25, when it is desired to engage or activate the child proof lock, lever 442 is activated by rotating pin 442A from the position shown in FIG. 24 to the position shown in FIG. 25 causing cam surface 448 to engage lever 516 to cause lever 516 to rotate on pin rivet 484, 488 positioning shoulder 542 out of alignment with pin 508. However, shoulder 544 is aligned with pin 508 and thus activation of lever 424 by for example handle 402 will permit the door to be opened from the outside.

To render the latch mechanism 400 in door 420 inoperative from the inside, pin 442 can be seen from the edge of the door and the driver need only slide it in slot 440 to the position shown in FIG. 25. As is also apparent because of the number of cam surfaces for engaging release lever 516, release lever 516 is thick so that cam arms 524 and cam surface 448 which are on different levels or planes so as not to interfere with one another in their movement, are able to engage lever 516.

Figure 26:
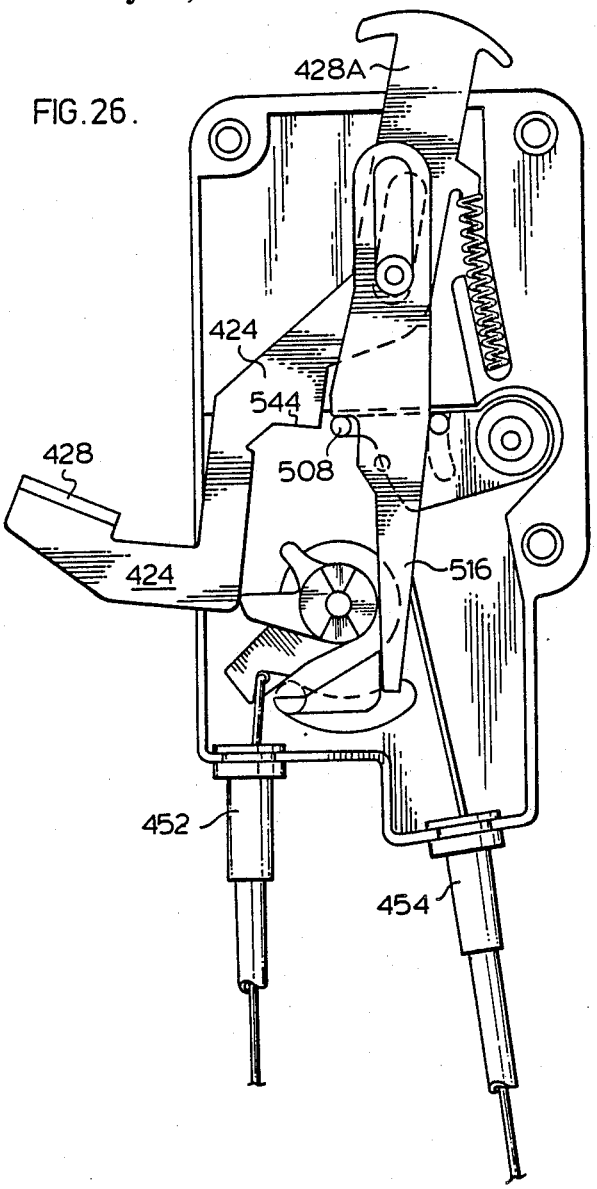

With respect to FIG. 26, cam body 514 has been modified to delete arm or lobe 524. Thus, except for the activation of the child proof lock, the inner handle will always be operative and the outer handle can be either operative or inoperative.

Figure 27:
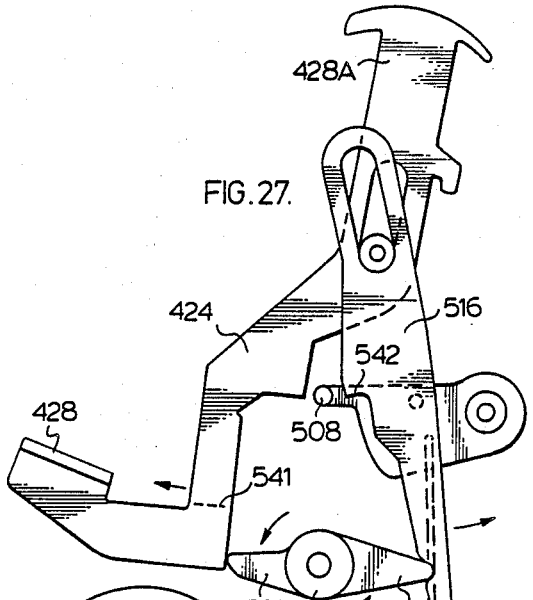
FIGS. 27 and 28 illustrate in plane the operation of some components of a latch mechanism similar to that shown in FIG. 19 when incorporating a handle on the inside of a car door for the operation thereof.
Figure 28:
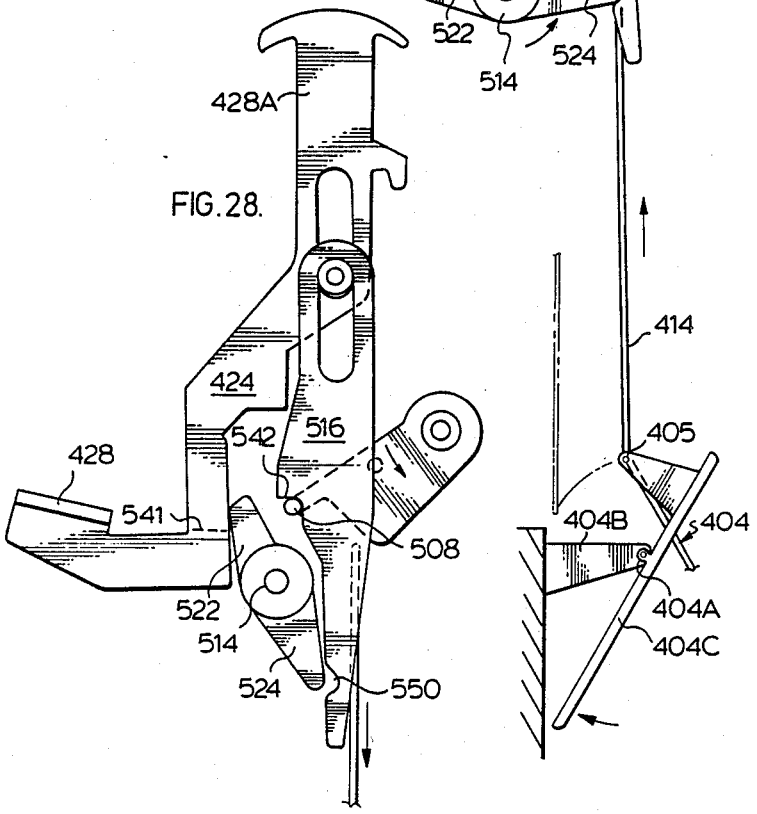

With respect to FIGS. 27 and 28, there is shown only a portion of the locking lever or cam lever 514, two levers 516 and 424 with both ends 428 and 428A which can be engaged by the outside handle 402, and rod 508. It is also apparent only cam arms or lobes 522 and 524 are shown of cam body 514, and lever 516 has been modified to provide a recess at the front thereof (see FIG. 28) identified as 550. Inside handle 404 cannot only be raised or lifted from the interior surface of the door about support 405 but also a lock button 404C is provided within the handle (only shown in FIG. 27) similar in structure to that shown in FIG. 7B to pivot about support 404B at pivot point 404A to push cable 414 inwardly.

With reference to FIG. 28, when lever 516 is pulled toward handle 404 by the elevation of handle 404, shoulder 542 engages pin 508 and the door is opened. However, when lock button 404C is activated pushing cable 414 rearwardly, the leading edge of cam arm 524 is caused to become lodged in recess 550 thereby rotating cam 514 from the position shown in FIG. 28 to the position shown in FIG. 27 thus spacing levers 516 and 424 away from pin 508 thus inactivating the handles and locking the door. Thus, using this system, a simple and effective manner of opening the doors is provided, activating the doors for opening and locking the doors and locking both the door from the inside and outside by use of a lock on a single handle using the wire or cable 414 secured to handle 404.

As is apparent, the embodiments shown in FIGS. 14 to 28 are suitable for use with the back door while the embodiments shown in FIGS. 1 to 13 are suitable for use with the front door (however, each could be modified for use with the front or back door as required).

With reference to FIGS. 29 to 34 inclusive, the embodiments shown in FIGS. 14 to 28 have been modified for use with a front door to include a key lock portion and to delete the childproof lockability therefrom. In this regard, latch mechanism 400 (3 cm in thickness) has been modified to alter the construction of lever 424 to delete portion 540 including end 428 thereof and employ solely portion 428A which was an alternative construction in that previously used. The release lever now identified as 624 contains end 624A identical to construction to end 428A. Lever 516 has been modified to be shorter and is identified as lever 616 and carries downwardly depending thicker portion 616A on the under side thereof and recess 617 in portion 616A. Cam body 514 has been modified to the structure shown in FIG. 30 and is identified as 614 and contains structures or arms 614A, 614B, 614C, 614D and 614E. Once again cam body may be injection moulded (as could 514). Instead of two cables and wires, only one cable or wire 614 has been provided, there being no equivalent to wire 408. Latch mechanism 600 carries slot 634 for the receipt of a striker identical in structure to slot 434 as are the pawl and ratchets and the connection in body 504 of the pawl to pin 508. Spring 498 is provided to connect to arm 624A of lever 624 and pinhead rivet 484, 488 is still provided to be received in slots 630 and 632. Only slot 670 is provided in the outer wall 664 of latch 600. Cavity 460 has been modified to provide cavity 660 comprising recessed portion defined by back wall 674B similar to back wall 474B and stepped raised portion defined by back wall 674A spaced by wall 674C from wall 674B. However, between the wall 662 (similar to wall 462) and raised step portion 674A, a recess or slot 700 is provided seen best in FIGS. 29 and 31 for receiving bent rod 702, one end of which is secured in arm portion 614A of cam body or lock lever 614 positioned to extend through aperture 678, in the same position as aperture 478. Recess 617 of lever 616 is provided for the same purposes as recess 550 and is defined at one end by a front wall 617A for engaging arm 614C when wire 614 is pushed rearwardly so that arm 614C becomes lodged in recess 617 rotating cam lever 614 (in this regard, see FIG. 32). Slot 710 is provided in inside wall 662 for receiving a body 712 being of columnar construction and carrying an inside flange 714 and an annular flange 716 for engaging the walls surrounding slot 710 of wall 662. Flange 714 carries boss 717 carrying bore 718 so that when body 712 rotates, bore 718 also rotates between the positions shown in FIGS. 31 and 32. Rod 702 is connected in bore 718 and thus as body 712 is rotated, rod 702 is caused to move from the position shown in FIG. 31 to the position shown in FIG. 32. Rod 702 is connected to arm 614A. Thus when rod 702 is caused to move, arm 614A is moved to the position shown in FIG. 32. Body 712 has an irregular shaped opening 712A (as opposed to circular) shown best in FIG. 29 being in effect two triangular portions meeting at their apexes to form a butterfly formation. Body 712 is joined to a key cylinder 720 (see FIG. 31), and thus insertion of a key into cylinder 720 and the turning thereof will cause body 712 to be rotated (because of the non-circular nature of opening 712A for receiving a like-shaped key element for rotating body 712). Thus the rotation of rod 702 rotates cam 614 about a vertical axis by the movement of arm 614A. Torsion spring 612 similar to torsion spring 512 is carried on a boss. One end of torsion spring 612 is lodged in a recess provided at 722 provided in wall 662 of latch mechanism 600. The other arm of torsion spring 612, namely arm 612A abuts against the bottom of cam or lock lever 614 sitting in aperture 678. Arm 612A does not abut any of the arms 614 but sits below arm 614E (the lowest arm). The manner of connecting wire 614' is the same as used to connect cable 414.

Figure 30:
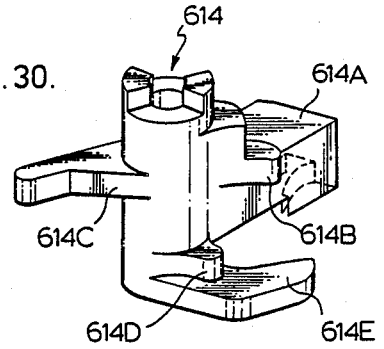
FIG. 30 is a perspective view of one of the components shown in FIG. 29.
Figure 29:
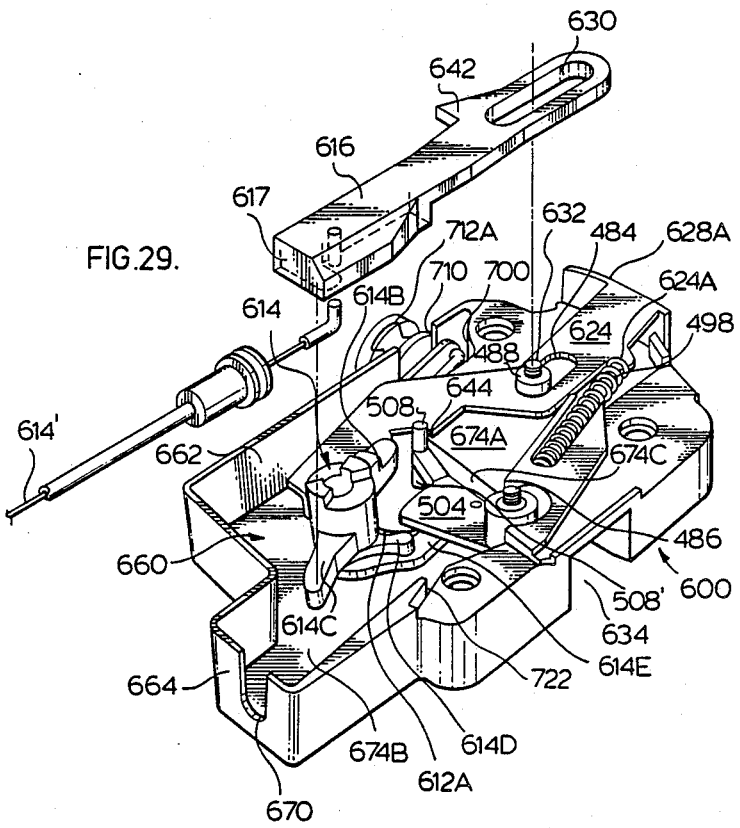
FIG. 29 is a perspective partly exploded view of another latch mechanism incorporating an operating mechanism according to another embodiment of the invention.
Figure 31:
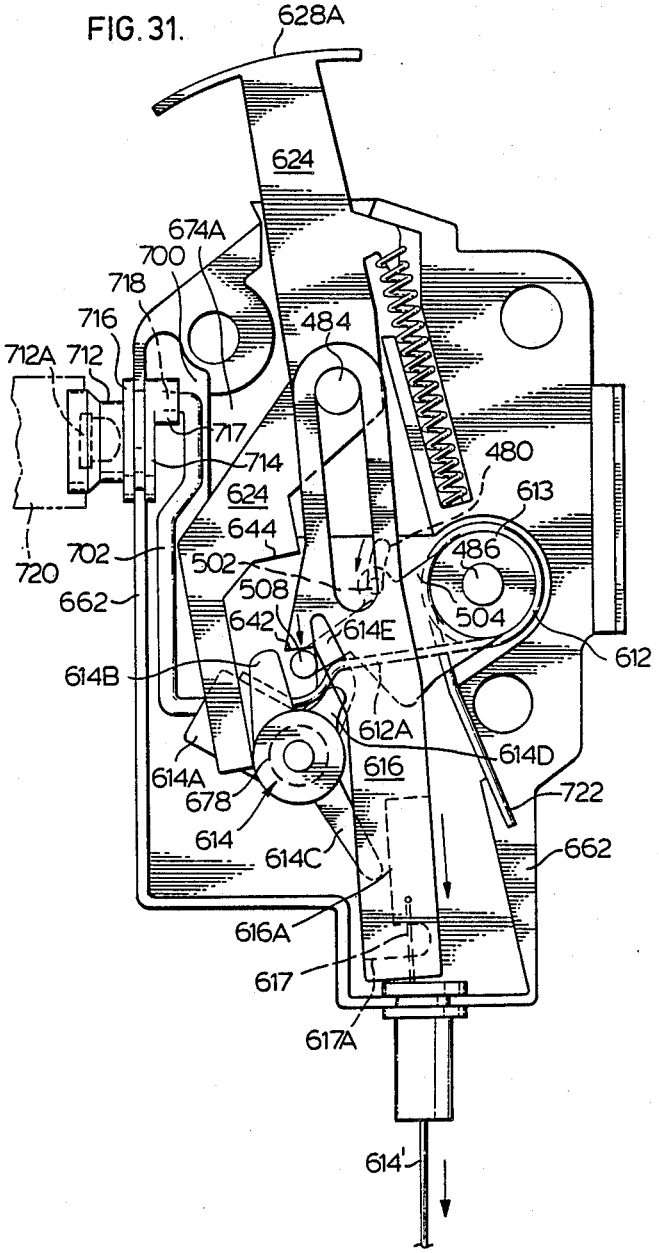
FIGS. 31 through 34 inclusive illustrate the various positions of the various component members of the mechanism shown in FIG. 29.
Figure 32:
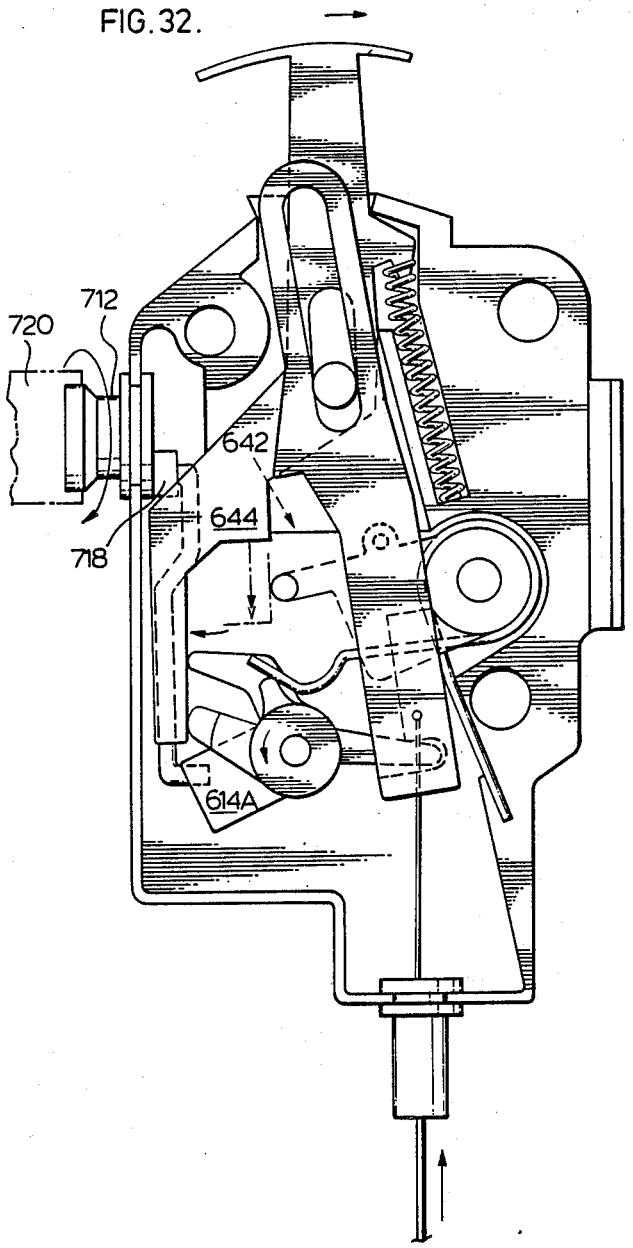
Figure 33:
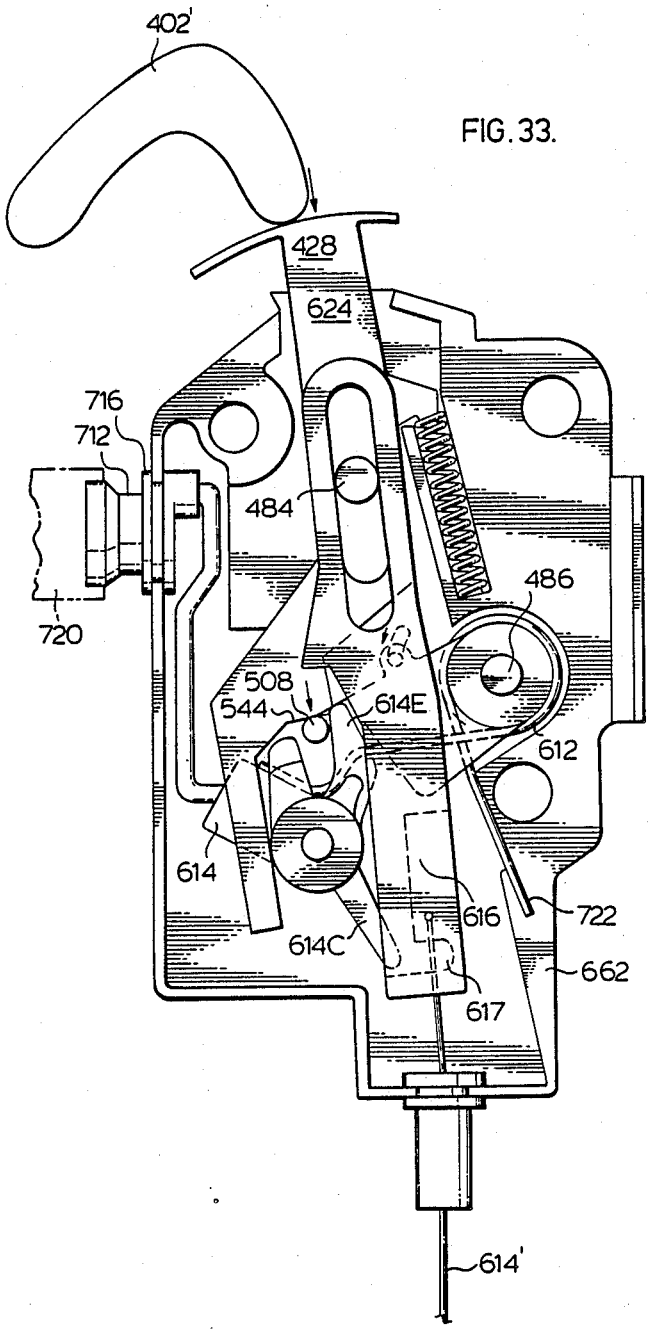

With reference to FIGS. 30 and 31, release levers 624 and 626 carry shoulders 644 and 642 respectively for engaging pin 508 which when engaged, rotates pin 502 in slot 480 for rotating the pawl for releasing the ratchet and thus the striker. By having cable 614' drawn in the direction of the arrow shown in FIG. 31, inside handle release lever 616 moves forward causing shoulder 612 to engage pin 508 and cause pin 508 to rotate arm 504 about pin 486 releasing the pawl and thus the ratchet. The position of cam lever or lock lever 614 shown in FIG. 31 is its normal position.

With reference to FIG. 31, the under side of lever 616 presents portion 616A for engaging arm 614C. When engaged by arm 614C, portion 616A does not permit rotation of arm 614C towards pin rivet 484, 488, and thus if lever 616 is pulled to the position shown in FIG. 31, the key cylinder 720 cannot be activated to render arm 624 inoperative. The addition of portion 616A protects locking lever 614 and the elements thereof from being damaged during operation. With respect to FIG. 32, when lever 616 is in the position shown in FIG. 29 with arm 614C in recess 617, the key cylinder 720 can be activated thus rotating body 712 rotating bore 718 and thus rod 702 to the position shown in FIG. 32. Thus, the door is locked. When a key is inserted into cylinder 720 and rotated, body 712 is rotated to the position shown in FIG. 33, outside handle 402' may be brought to bear against surface 428A depressing lever 624 to cause shoulder 544 to engage pin 508 opening the door. As will be observed, arm 614C is not in recess 617.

Figure 34:
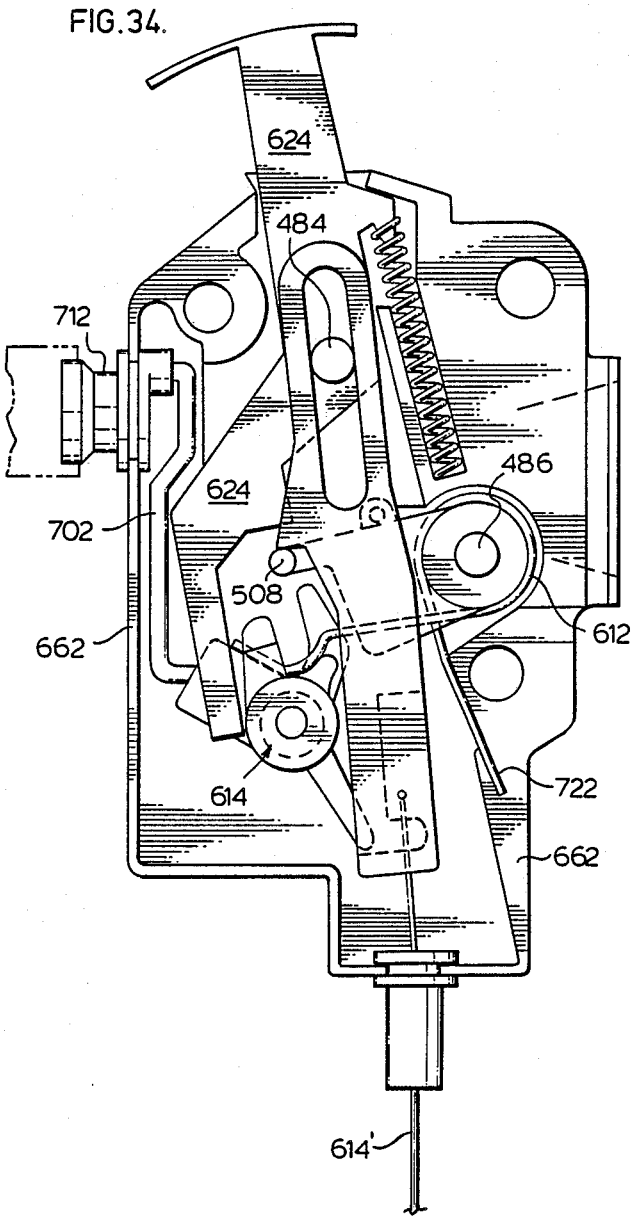

With respect to FIG. 34, the door is closed and is in the latched position allowing the key or the interior lock (if any) to be operated.

As many changes can be made to the invention without departing from the scope thereof, it is intended that all matter herein be interpreted illustrative of the invention and not in a limiting sense. For example, an anti-locking feature to prevent accidental lockout has been provided so that for locking the front door, a key must be used. In this regard, a pin on the pawl of the structural portion of the latch moves to a predetermined position when the door is closed. By adding an additional arm on the locking lever, the pin connected in some manner to the pawl can be engaged by the additional arm which prevents the locking lever rotating unless the door is closed. Therefore, one cannot lock the door when the door is open, and must be shut. This additional feature is added at no additional cost, because this lever can be added or moulded with locking lever or cam 614.

In this regard, arm 614E is provided to be interfered with by the lower part 508' of pin 508 so as to preclude rotation of lever 614 when the door is open (see FIG. 31).

The embodiments of the invention in which an exclusive property or privilege is claimed are as follows:

1. An operating mechanism suitable for use in a vehicle door latch mechanism comprising structural components for locking, the operating mechanism comprising:
   (a) an inside handle release lever for being operated from the inside of the door;
   (b) an outside handle release lever for being operated from the outside of the door;
   (c) means for being engaged by the inside handle release lever and outside handle release lever, said means being connected to release the structural components of the latch mechanism for operation;
   (d) at least one of the said inside handle release lever and outside handle release lever being movable to a position whereat the release lever cannot engage said means to release the structural components when operated.

2. The operating mechanism of claim 1 wherein at least the outside handle release lever is movable to a position whereat the release lever cannot engage said means to release the structural components when operated.

3. The operating mechanism of claim 1, wherein the structural components comprise a pawl and ratchet.

4. The operating mechanism of claim 2, wherein the structural components comprise a pawl and ratchet.

5. The operating mechanism of claim 1, wherein the operation of the inside handle release lever and outside handle release lever directly operates said means (as opposed to indirected operation through other components).

6. The operating mechanism of claim 2, wherein the operation of the inside handle release lever and outside handle release lever directly operates said means (as opposed to indirected operation through other components).

7. The operating mechanism of claim 3, wherein the operation of the inside handle release lever and outside handle release lever directly operates said means (as opposed to indirected operation through other components).

8. The operating mechanism of claim 4, wherein the operation of the inside handle release lever and outside handle release lever directly operates said means (as opposed to indirected operation through other components).

9. The operating mechanism of claim 1, wherein each release lever carries a shoulder for engaging said means.

10. The orperating mechanism of claim 2, wherein each release lever carries a shoulder for engaging said means.

11. The operating mechanism of claim 3, wherein each release lever carries a shoulder for engaging said means.

12. The operating mechanism of claim 4, wherein each release lever carries a shoulder for engaging said means.

13. The operating mechanism of claim 5, wherein each release lever carries a shoulder for engaging said means.

14. The operating mechanism of claim 6, wherein each release lever carries a shoulder for engaging said means.

15. The operating mechanism of claim 7, wherein each release lever carries a shoulder for engaging said means.

16. The operating mechanism of claim 8, wherein each release lever carries a shoulder for engaging said means.

17. The operating mechanism of claim 1, wherein only one lever carries a shoulder for such engagement with said means and the other lever is rotatable in and out of engagement with said means.

18. The operating mechanism of claim 2, wherein only one lever carries a shoulder for such engagement with said means and the other lever is rotatable in and out of engagement with said means.

19. The operating mechanism of claim 3, wherein only one lever carries a shoulder for such engagement with said means and the other lever is rotatable in and out of engagement with said means.

20. The operating mechanism of claim 4, wherein only one lever carries a shoulder for such engagement with said means and the other lever is rotatable in and out of engagement with said means.

21. The operating mechanism of claim 5, wherein only one lever carries a shoulder for such engagement with said means and the other lever is rotatable in and out of engagement with said means.

22. The operating mechanism of claim 6, wherein only one lever carries a shoulder for such engagement with said means and the other lever is rotatable in and out of engagement with said means.

23. The operating mechansim of claim 7, wherein only one lever carries a shoulder for such engagement with said means and the other lever is rotatable in and out of engagement with said means.

24. The operating mechanism of claim 8, wherein only one lever carries a shoulder for such engagement with said means and the other lever is rotatable in and out of engagement with said means.

25. The operating mechanism of claim 1, wherein at least one of the release levers slides longitudinally to engage said means and is pivotable (about a pivot) so that longitudinal sliding movement of the release lever when the release lever has been pivoted, does not permit the release lever to engage said means.

26. The operating mechanism of claim 2, wherein at least one of the release levers slides longitudinally to engage said means and is pivotable (about a pivot) so that longitudianal sliding movement of the release lever when the release lever has been pivoted, does not permit the release lever to engage said means.

27. The operation mechanism of claim 5, wherein at least one of the release levers slides longitudinally to engage said means and is pivotable (about a pivot) so that longitudinal sliding movement of the release lever when the release lever has been pivoted, does not permit the release lever to engage said means.

28. The operating mechanism of claim 6, wherein at least one of the release levers slides longitudinally to engage said means and is pivotable (about a pivot) so that longitudinal sliding movement of the release lever when the release lever has been pivoted, does not permit the release lever to engage said means.

29. The operating mechanism of claim 1, wherein both release levers are slideable to engage said means and are pivotable to positions which will not permit engagement by said release levers with said means.

30. The operating mechanism of claim 2, wherein both release levers are slideable to engage said means and are pivotable to positions which will not permit engagement by said release levers with said means.

31. The operating mechanism of claim 5, wherein both release levers are slideable to engage said means and are pivotable to positions which will not permit engagement by said release levers with said means.

32. The operating mechanism of claim 6, wherein both release levers are slideable to engage said means and are pivotable to positions which will not permit engagement by said release levers with said means.

33. The operating mechanism of claim 25, wherein a longitudinally extending slot is provided in each lever, the release levers overlie one another, supported on a pin for limited sliding longitudinal movement with respect thereto and the release levers are spring biased towards one another.

34. The operating mechanism of claim 26, wherein a longitudinally extending slot is provided in each lever, the release levers overlie one another, are supported on a pin for limited sliding longitudinal movement with respect thereto and the release levers are spring biased towards one another.

35. The operating mechanism of claim 27, wherein a longitudinally extending slot is provided in each lever, the release levers overlie one another, are supported on a pin for limited sliding longitudinal movement with respect thereto and the release levers are spring biased towards one another.

36. The operating mechanism of claim 28, wherein a longitudinally extending slot is provided in each lever, the release levers overlie one another, are supported on a pin for limited sliding longitudinal movement with respect thereto and the release levers are spring biased towards one another.

37. The operating mechanism of claim 29, wherein a longitudinally extending slot is provided in each lever, the release levers overlie one another, are supported on a pin for limited sliding longitudinal movement with respect thereto and the release levers are spring biased towards one another.

38. The operating mechanism of claim 30, wherein a longitudinally extending slot is provided in each lever, the release levers overlie one another, are supported on a pin for limited sliding longitudinal movement with respect thereto and the release levers are spring biased towards one another.

39. The operating mechanism of claim 31, wherein a longitudinally extending slot is provided in each lever, the release levers overlie one another, are supported on a pin for limited sliding longitudinal movement with respect thereto and the release levers are spring biased towards one another.

40. The operating mechanism of claim 32, wherein a longitudinally extending slot is provided in each lever, the release levers overlie one another, are supported on a pin for limited sliding longitudinal movement with repect thereto and the release levers are spring biased towards one another.

41. The operating mechanism of claim 33, wherein a rotatable cam lever or locking lever is provided to rotate the inside handle release lever, the outside handle release lever and/or both levers out of their normal position against the action of the spring so that longitudinal sliding movement will not permit engagement with said means.

42. The operating mechanism of claim 34, wherein a rotatable cam lever or locking lever is provided to rotate the inside handle release lever, the outside handle release lever and/or both levers out of their normal position against the action of the spring so that longitudinal sliding movement will not permit engagement with said means.

43. The operating mechanism of claim 35, wherein a rotatable cam lever or locking lever is provided to rotate the inside handle release lever, the outside handle release lever and/or both levers out of their normal position against the action of the spring so that longitudinal sliding movement will not permit engagement with said means.

44. The operating mechanism of claim 36, wherein a rotatable cam lever or locking lever is provided to rotate the inside handle release lever, the outside handle release lever and/or both levers out of their normal position against the action of the spring so that longitudinal sliding movement will not permit engagement with said means.

45. The operating mechanism of claim 37, wherein a rotatable cam lever or locking lever is provided to rotate the inside handle release lever, the outside handle release lever and/or both levers out of their normal position against the action of the spring so that longitudinal sliding movement will not permit engagement with said means.

46. The operating mechanism of Claim 38, wherein a rotatable cam lever or locking lever is provided to rotate the inside handle release lever, the outside handle release lever and/or both levers out of their normal position against the action of the spring so that longtitudinal sliding movement will not permit engagement with said means.

47. The operating mechanism of claim 39, wherein a rotatable cam lever or locking lever is provided to rotate the inside handle release lever, the outside handle release lever and/or both levers out of their normal position against the action of the spring so that longitudinal sliding movement will not permit engagement with said means.

48. The operating mechanism of claim 40, wherein a rotatable cam lever or locking lever is provided to rotate the inside handle release lever, the outside handle release lever and/or both levers out of their normal position against the action of the spring so that longitudinal sliding movement will not permit engagemeent with said means.

49. The operating mechanism of claim 1, wherein the inside handle release lever is rotatable about a pivot point and said outside handle lever is slideable longitudinally to engage said means and is pivotable to a position whereat slideable movement will not permit engagement of said means.

50. The operating mechanism of claim 2, wherein the inside handle release lever is rotatable about a pivot point and said outside handle lever is slideable longitudinally to engage said means and is pivotable to a position whereat slideable movement will not permit engagement of said means.

51. The operating mechanism of claim 3, wherein the inside handle release lever is rotatable about a pivot point and said outside handle lever is slideable longitudinally to engage said means and is pivotable to a position whereat slideable movement will not permit engagement of said means.

52. The operating mechanism of claim 4, wherein the inside handle release lever is rotatable about a pivot point and said outside handle lever is slideable longitudinally to engage said means and is pivotable to a position whereat slideable movement will not permit engagement of said means.

53. The operating mechanism of claim 5, wherein the inside handle release lever is rotatable about a pivot point and said outside handle lever is slideable longitudinally to engage said means and is pivotable to a position whereat slideable movement will not permit engagement of said means.

54. The operating mechanism of claim 6, wherein the inside handle release lever is rotatable about a pivot point and said outside handle lever is slideable longitudinally to engage said means and is pivotable to a position whereat slideable movement will not permit engagement of said means.

55. The operating mechanism of claim 7, wherein the inside handle release lever is rotatable about a pivot point and said outside handle lever is slideable longitudinally to engage said means and is pivotable to a position whereat slideable movement will not permit engagement of said means.

56. The operating mechanism of claim 8, wherein the inside handle release lever is rotatable about a pivot point and said outside handle lever is slideable longitudinally to engage said means and is pivotable to a position whereat slideable movement will not permit engagement of said means.

57. The operating mechanism of claim 17, wherein said means comprises an arm rotatable about a central pivot, the rotation thereof releasing the structural components of the latch for operation, one end of the arm for engagement by the inside handle release lever and the other end for being engaged by the outside handle release lever.

58. The operating mechanism of claim 18, wherein said means comprises an arm rotatable about a central pivot, the rotation thereof releasing the structural components of the latch for operation, one end of the arm for engagement by the inside handle release lever and the other end for being engaged by the outside handle release lever.

59. The operating mechanism of claim 19, wherein said means comprises an arm rotatable about a central pivot, the rotation thereof releasing the structural components of the latch for operation, one end of the arm for engagement by the inside handle release lever and the other end for being engaged by the outside handle release lever.

60. The operating mechanism of claim 20, wherein said means comprises an arm rotatable about a central pivot, the rotation thereof releasing the structural components of the latch for operation, one end of the arm for engagement by the inside handle release lever and the other end for being engaged by the outside handle release lever.

61. The operating mechanismo of claim 21, wherein said means comprises an arm rotatable about a central pivot, the rotation thereof releasing the structural components of the latch for operation, one end of the arm for engagement by the inside handle release lever and the other end for being engaged by the outside handle release lever.

62. The operating mechanism of claim 22, wherein said means comprises an arm rotatable about a central pivot, the rotation thereof releasing the structural components of the latch for operation, one end of the arm for engagement by the inside handle release lever and the other end for being engaged by the outside handle release lever.

63. The operating mechanism of claim 23, wherein said means comprises an arm rotatable about a central pivot, the rotation thereof releasing the structural components of the latch for operation, one end of the arm for engagement by the inside handle release lever and the other end for being engaged by the outside handle release lever.

64. The operating mechanism of claim 24, wherein said means comprises an arm rotatable about a central pivot, the rotation thereof releasing the structural components of the latch for operation, one end of the arm for engagement by the inside handle release lever and the other end for being engaged by the outside handle release lever.

65. The operating mechanism of claim 49, wherein said means comprises an arm rotatable about a central pivot, the rotation thereof releasing the structural components of the latch for operation, one end of the arm for engagement by the inside handle release lever and the other end for being engaged by the outside handler release lever.

66. The operating mechanism of claim 50, wherein said means comprises an arm rotatable about a central pivot, the rotation thereof releasing the structural components of the latch for operation, one end of the arm for engagement by the inside handle release lever and the other end for being engaged by the outside handle release lever.

67. The operating mechanism of claim 51, wherein said means comprises an arm rotatable about a central pivot, the rotation thereof releasing the structural components of the latch for operation, one end of the arm for engagement by the inside handle release lever and the other end for being engaged by the outside handle release lever.

68. The operating mechanism of claim 52, wherein said means comprises an arm rotatable about a central pivot, the rotation thereof releasing the structural components of the latch for operation, one end of the arm for engagement by the inside handle release lever and the other end for being engaged by the outside handle release lever.

69. The operating mechanism of claim 53, wherein said means comprises an arm rotatable about a central pivot, the rotation thereof releasing the structural components of the latch for operation, one end of the arm for engagement by the inside handle release lever and the other end for being engaged by the outside handle release lever.

70. The operating mechanism of claim 54, wherein said means comprises an arm rotatable about a central pivot, the rotation thereof releasing the structural components of the latch for operation, one end of the arm for engagement by the inside handle release lever and the other end for being engaged by the outside handle release lever.

71. The operating mechanism of claim 55, wherein said means comprises an arm rotatable about a central pivot, the rotation thereof releasing the structural components of the latch for operation, one end of the arm for engagement by the inside handle release lever and the other end for being engaged by the outside handle release lever.

72. The operating mechanism of claim 56, wherein said means comprises an arm rotatable about a central pivot, the rotation thereof releasing the structural components of the latch for operation, one end of the arm for engagement by the inside handle release lever and the other end for being engaged by the outside handle release lever.

73. The operating mechansim of claim 57, wherein a cam arm or locking lever is provided and rotated by the inside handle release lever to position the outside handle release lever in a position whereat it cannot engage said means.

74. The operating mechanism of claim 58, wherein a cam arm or locking lever is provided and rotated by the inside handle release lever to position the outside handle release lever in a position whereat it cannot engage said means.

75. The operating mechanism of claim 59, wherein a cam arm or locking lever is provided and rotated by the inside handle release lever to position the outside handle release lever in a position whereat it cannot engage said means.

76. The operating mechanism of claim 60, wherein a cam arm or locking lever is provided and rotated by the inside handle release lever to position the outside handle release lever in a position whereat it cannot engage said means.

77. The operating mechanism of claim 61, wherein a cam arm or locking lever is provided and rotated by the inside handle release lever to position the outside handle release lever in a position whereat it cannot engage said means.

78. The operating mechanism of claim 62, wherein a cam arm or locking lever is provided and rotated by the inside handle release lever to position the outside handle release lever in a position whereat it cannot engage said means.

79. The operaating mechanism of claim 63, wherein a cam arm or locking lever is provided and rotated by the inside handle release lever to position the outside handle release lever in a position whereat it cannot engage said means.

80. The operating mechanism of claim 64, wherein a cam arm or locking lever is provided and rotated by the inside handle release lever to position the outside handle release lever in a position whereat it cannot engage said means.

81. The operating mechanism of claim 65, wherein a cam arm or locking lever is provided and rotated by the inside handle release lever to position the outside handle release lever in a position whereat it cannot engage said means.

82. The operating mechanism of claim 66, wherein a cam arm or locking lever is provided and rotated by the inside handle release lever to position the outside handle release lever in a position whereat it cannot engage said means.

83. The operating mechanism of claim 67, wherein a cam arm or locking lever is provided and rotated by the inside handle release lever to position the outside handle release lever in a position whereat it cannot engage said means.

84. The operating mechanism of claim 68, wherein a cam arm or locking lever is provied and rotated by the inside handle release lever to position the outside handle release lever in a position whereat it cannot engage said means.

85. The operating mechanism of claim 69, wherein a cam arm or locking lever is provided and rotated by the inside handle release lever to position the outside handle release lever in a position whereat it cannot engage said means.

86. The operating mechanism of claim 70, wherein a cam arm or locking lever is provided and rotated by the inside handle release lever to position the outside handle release lever in a position whereat it cannot engage said means.

87. The operating mechanism of claim 71, wherein a cam arm or locking lever is provided and rotated by the inside handle release lever to position the outside handle release lever in a position whereat it cannot engage said means.

88. The operating mechanism of claim 72, wherein a cam arm or locking lever is provided and rotated by the inside handle release lever to position the outside handle release lever in a position whereat it cannot engage said means.

89. The operating mechanism of claim 1, further comprising a key cylinder connected to a cam arm or locking lever to operate the outside handle release lever to rotate the outside handle release lever between positions whereat the lever when moved longitudinally will not engage the means being connected to release the structural components.

90. The operating mechanism of claim 2, further comprising a key cylinder connected to a cam arm or locking lever to operate the outside handle release lever to rotate the outside handle release lever between positions whereat the lever when moved longitudinally will not engage the means being connected to release the structural components.

91. The operating mechanism of claim 3, further comprising a key cylinder connected to a cam arm or locking lever to operate the outside handle release lever to rotate the outside handle release lever between positions whereat the lever when moved logitudinally will not engage the means being connected to release the structural components.

92. The operating mechanis of claim 4, further comprising a key cylinder connected to a cam arm or locking lever to operate the outside handle release lever to rotate the outside handle release lever between positions whereat the lever when moved longitudinally will not engage the means being connected to release the structural components.

93. The operating mechanism of claim 5, further comprising a key cylinder connected to a cam arm or locking lever to operate the outside handle release lever to rotate the outside handle release lever between positions whereat the lever when moved longitudinally will not engage the means being connected to release the structural components.

94. The operating mechanism of claim 6, further comprising a key cylinder connected to a cam arm or locking lever to operate the outside handle release lever to rotate the outside handle release lever between positions whereat the lever when moved longitudinally will not engage the means being connected to release the structural components.

95. The operating mechanism of claim 7, further comprising a key cylinder connected to a cam arm or locking lever to operate the outside handle release lever to rotate the outside handle release lever between positions whereat the lever when moved longitudinally will not engage the means being connected to release the structural components.

96. The operating mechanism of claim 8, further comprising a key cylinder connected to a cam arm or locking lever to operate the outside handle release lever to rotate the outside handle release lever between positions whereat the lever when moved longitudinally will not engage the means being connected to release the structural components.

97. The operating mechansism of claim 9, further comprising a key cylinder connected to a cam arm or locking lever to operate the outside handle release lever to rotate the outside handle release lever between positions whereat the lever when moved longitudinally will not engage the means being connected to release the structural components.

98. The operating mechanism of claim 10, further comprising a key cylinder connected to a cam arm or locking lever to operate the outside handle release lever to rotate the outside handle release lever between positions whereat the lever when moved longitudinally will not engage the means being connected to release the structural components.

99. The operating mechanism of claim 11, further comprising a key cylinder connected to a cam arm or locking lever to operate the outside handle release lever to rotate the ouside handle release lever between positions whereat the lever when moved longitudinally will not engage the means being connected to release the structural components.

100. The operating mechanism of claim 25, further comprising a key cylinder connected to a cam arm or locking lever to operate the outside handle release lever to rotate the outside handle release lever between positions whereat the lever when moved longitudinally will not engage the means being connected to release the structural components.

101. The operating mechanism of claim 26, further comprising a key cylinder connected to a cam arm or locking lever to operate the outside handle release lever to rotate the outside handle release lever between positions whereat the lever when moved longitudinally will not engage the means being connected to release the structural components.

102. The operating mechanism of claim 27, further comprising a key cylinder connected to a cam arm or locking lever to operate the outside handle release lever to rotate the outside handle release lever between positions whereat the lever when moved longitudinally will not engage the means being connected to release the structural components.

103. The operating mechanism of claim 28, further comprising a key cylinder connected to a cam arm or locking lever to operate the outside handle release lever to rotate the outside handle release lever bwtween positions whereat the lever when moved longitudinally will not engage the means being connected to release the structural components.

104. The operating mechanism of claim 49, further comprising the inside handle of a door being connected by a single cable (Bowden cable) to rotate the inside handle release lever (and return the lever to its original position) to move the outside handle release lever to a position whereat slideable longitudinal movement of the outside handle release lever will engage the means being connected to release the structural components (if the outside handle is not in that position) and thereafter engage the arm rotatable about a central pivot (the means being connected to release the structural components) to cause release of the structural components to release the door for opening.

105. The operating mechanism of claim 50, further comprising the inside handle of a door being connected by a single cable (Bowden cable) to rotate the inside handle release lever (and return the lever to its original position) to move the outside handle release lever to a position whereat slideable longitudinal movement of the outside handle release lever will engage the means being connected to release the structural components (if the outside handle is not in that position) and thereafter engage the arm rotatable about a central pivot (the means being connected to release the structural components) to cause release of the structural components to release the door for opening.

106. The operating mechanism of claim 51, further comprising the inside handle of a door being connected by a single cable (Bowden cable) to rotate the inside handle release lever (and return the lever to its original position) to move the outside handle release lever to a position whereat slideable longitudinal movement of the outside handle release lever will engage the means being connected to release the structural components (if the outside handle is not in that position) and thereafter engage the arm rotatable about a central pivot (the means being connected to release the structural components) to cause release of the structural components to release the door for opening.

107. The operating mechanism of claim 52, further comprising the inside handle of a door being connected by a single cable (Bowden cable) to rotate the inside handle release lever (and return the lever to its original position) to move the outside handle release lever to a position whereat slideable longitudinal movement of the outside handle release lever will engage the means being connected to release the structural components (if the outside handle is not in that position) and thereafter engage the arm rotatable about a central pivot (the means being connected to release the structural components) to cuase release of the structural components to release the door for opening.

108. The operating mechanism of claim 53, further comprising the inside handle of a door being connected by a single cable (Bowden cable) to rotate the inside handle release lever (and return the lever to its original position) to move the outside handle release lever to a position whereat slideable longitudinal movement of the outside handle release lever will engage the means being connected to release the structural components (if the outside handle is not in that position) and thereafter engage the arm rotatable about a central pivot (the means being connected to release the structural components) to cause release of the structural components to release the door for opening.

109. The operating mechanism of claim 54, further comprising the inside handle of a door being connected by a single cable (Bowden cable) to rotate the inside handle release lever (and return the lever to its original position) to move the outside handle release lever to a position whereat slideable longitudinal movement of the outside handle release lever will engage the means being connected to release the structural components (if the outside handle is not in that position) and thereafter engage the arm rotatable about a central pivot (the means being connected to release the structural components) to cause release of the structural components to release the door for opening.

110. The operating mechanism of claim 55, further comprising the inside handle of a door being connected by a single cable (Bowden cable) to rotate the inside handle release lever (and return the lever to its original position) to move the outside handle release lever to a position whereat slideable longitudinal movement of the outside handle release lever will engage the means being connected to release the structural components (if the outside handle is not in that position) and thereafter engage the arm rotatable about a central pivot (the means being connected to release the structural components) to cause release of the structural components to release the door for opening.

111. The operating mechanism of claim 56, further comprising the inside handle of a door being connected by a single cable (Bowden cable) to rotate the inside handle release lever (and return the lever to its original positon) to move the outside handle release lever to a position whereat slideable longitudinal movement of the outside handle release lever will engage the means being connected to release the structural components (if the outside handle is not in that position) and thereafter engage the arm rotatable about a central pivot (the means being connected to release the structural components) to cause release of the structural components to release the door for opening.

112. The operating mechanism of claim 104, further comprising the inside handle having associated with the handle and its operation, a handle lock lever which pivots like the handle towards and away from the door (and in the same direction as the handle when the door is to be opened) the handle lock lever being operable by the handle to operate with the handle when the door is to be opened, the handle lock lever when either depressed or raised, causes the outside handle release lever to be moved to a position whereat the outside handle release lever does not engage the means (for example, the arm) to release the structural components.

113. The operating mechanism of claim 105, further comprising the inside handle having associated with the handle and its operation, a handle lock lever which pivots like the handle towards and away from the door (and in the same direction as the handle when the door is to be opened) the handle lock lever being operable by the handle to operate with the handle when the door is to be opened, the handle lock lever when either depressed or raised, causes the outside handle release lever to be moved to a position whereat the outside handle release lever does not engage the means (for example, the arm) to release the structural components.

114. The operating mechanism of claim 106, further comprising the inside handle having associated with the handle and its operation, a handle lock lever which pivots like the handle towards and away from the door (and in the same direction as the handle when the door is to be opened) the handle lock lever being operable by the handle to operate with the handle when the door is to be opened, the handle lock lever when either depressed or raised, causes the outside handle release lever to be moved to a position whereat the outside handle release lever does not engage the means (for example, the arm) to release the structural components.

115. The operating mechanism of claim 107, further comprising the inside handle having associated with the handle and its operation, a handle lock lever which pivots like the handle towards and away from the door (and in the same direction as the handle when the door is to be opened) the handle lock lever being operable by the handle to operate with the handle when the door is to be opened, the handle lock lever when either depressed or raised, causes the outside handle release lever to be moved to a position whereat the outside handle release lever does not engage the means (for example, the arm) to release the structural components.

116. The operating mechanism of claim 108, further comprising the inside handle having associated with the handle and its operation, a handle lock lever which pivots like the handle towards and way from the door (and in the same direction as the handle when the door is to be opened) the handle lock lever being operable by the handle to operate with the handle when the door is to be opened, the handle lock lever when either depressed or raised, causes the outside handle release lever to be moved to a position whereat the outside handle release lever does not engage the means (for example, the arm) to release the structural components.

117. The operating mechanism of claim 109, further comprising the inside handle having associated with the handle and its operation, a handle lock lever which pivots like the handle towards and away from the door (and in the same direction as the handle when the door is to be opened) the handle lock lever being operable by the handle to operate with the handle when the door is to be opened, the handle lock lever when either depressed or raised, causes the outside handle release lever to be moved to a position whereat the outside handle release lever does not engage the means (for example, the arm) to release the structural components.

118. The operating mechanism of claim 110, further comprising the inside handle having associated with the handle and its operation, a handle lock lever which pivots like the handle towards and away from the door (and in the same direction as the handle when the door is to be opened) the handle lock lever being operable by the handle to operate with the handle when the door is to be opened, the handle lock lever when either depressed or raised, causes the outside handle release lever to be moved to a position whereat the outside handle release lever does not engage the means (for example, the arm) to release the structural components.

119. The operating mechanism of claim 111, further comprising the inside handle having associated with the handle and its operation, a handle lock lever which pivots like the handle towards and away from the door (and in the same direction as the handle when the door is to be opened) the handle lock lever being operable by the handle to operate with the handle when the door is to be opened, the handle lock lever when either depressed or raised, causes the outside handle release lever to be moved to a position whereat the outside handle release lever does not engage the means (for example, the arm) to release the structural components.

120. The operating mechanism of claim 112, wherein the inside handle release lever is forked, one space between one set of forks for positioning the arms (means therebetween for releasing the structural components) and another space for receiving the end of the cam arm whereby when the inside handle is pulled or depressed to open the door, the arm is first caused to move the outsie handle release lever to the position to engage the means to release the structural components if moved longitudinally and then the inside handle release lever engages the means to release the structural components.

121. The operating mechanism of claim 113, wherein the inside handle release lever is forked, one space between one set of forks for positioning the arms (means therebetween for releasing the structural components) and another space for receiving the end of the cam arm whereby when the inside handle is pulled or depressed to open the door, the arm is first caused to move the outside handle release lever to the position to engage the means to release the structural components if moved longitudinally and then the inside handle release lever engages the means to release the structural components.

122. The operating mechanism of claim 114, wherein the inside handle release lever is forked, one space between one set of forks for positioning the arms (means therebetween for releasing the structural components) and another space for receiving the end of the cam arm whereby when the inside handle is pulled or depressed to open the door, the arm is first caused to move the outside handle release lever to the position to engage the means to release the structural components if moved longitudinally and then the inside handle release lever engages the means to release the structural components.

123. The operating mechanism of claim 115, wherein the inside handle release lever is forked, one space between one set of forks for positioning the arms (means therebetween for releasing the structural components) and another space for receiving the end of the cam arm whereby when the inside handle is pulled or depressed to open the door, the arm is first caused to move the outside handler release lever to the positon to engage the means to release the structural components if moved longitudinally and then the inside handle release lever engages the means to release the structural components.

124. The operaing mechanism of claim 116, wherein the inside handle release lever is forked, one space between one set of forks for positioning the arms (means therebetween for releasing the structural components) and another space for receiving the end of the cam arm whereby when the inside handle is pulled or depressed to open the door, the arm is first caused to move the outside handle release lever to the position to engage the means to release the structural components if moved longitudinally and then the inside handle release lever engages the means to release the structural components.

125. The operating mechanism of claim 117, wherein the inside handle release lever is forked, one space between one set of forks for positioning the arms (means therebetween for releasing the structural components) and another space for receiving the end of the cam arm whereby when the inside handle is pulled or depressed to open the door, the arm is first caused to move the outside handle release lever to the position to engage the means to release the structural components if moved longitudinally and then the inside handle release lever engages the means to release the structural components.

126. The operating mechanism of claim 118, wherien the inside handle release lever is forked, one space between one set of forks for positioning the arms (means therebetween for releasing the structural components) and another space for receiving the end of the cam arm whereby when the inside handle is pulled or depressed to open the door, the arms is first caused to move the outside handle release lever to the position to engage the means to release the structural components if moved longitudinally and then the inside handle release lever engages the means to release the structural components.

127. The operating mechanism of claim 119, wherein the inside handle release lever is forked, one space between one set of forks for positioning the arms (means therebetween for releasing the structural components) and another space for receiving the end of the cam arm whereby when the inside handle is pulled or depressed to open the door, the arms is first caused to move the outside handle release lever to the position to engage the means to release the structural components if moved longitudinally and then the inside handle release lever engages the means to release the structural components.

128. An operating mechanism for operating the structural components of a door latch mechanism, the operating mechanism comprising a pair of release levers, an outside handle release lever and an inside handle release lever at least one release lever carrying a longitudinal slot and being supported (by means of the longitudinal slot) on a pin, the said at least one release lever carrying a shoulder, the said levers for being connected to operate the inside door handle and the outside door handle for permitting opening of the car door, and means to be engaged by the levers for operating the structural components of the lock, at least one of the levers being moveable to a position whereat it cannot engage the said means.

129. The operating mechanism of claim 128, wherein the two release levers each carrying a shoulder and slot, the two levers are spring biased towards one another and a locking lever (cam) is provided between the two and carries cam surfaces thereon, so that when the release levers are in their normally spaced position, the shoulders of each are aligned with the means so that the longitudinal movement of one the levers towards the pin permits engagement of the shoulder with said means attached to the structural components releasing for example, the pawl and thus the ratchet, unlocking the door and whereby when the cam surfaces on the locking lever (cam) are moved to different positions the levers swing further from one another so that longitudinal movement of at least one of the levers will not engage said means connected to the structural parts until the locking lever is returned to the normal position releasing the at least one release lever to be spring biased towards the other release lever to their normal engaging positions aligned with said means secured to the structural parts of the door latch mechanism.

130. A door latch mechanism comprising the operating mechanism as claimed in claim 128 and a ratchet and a pawl (structural components) in a plastic modular case for assembly into a vehicle door, said means being connected to operate the pawl and ratchet to unlock the vehicle door.

131. A door latch mechanism comprising the operating mechanism as claimed in claim 129 and a ratched and a pawl (structural components) in a plastic modular case for assembly into a vehicle door, said means being connected to operate the pawl and ratchet to unlock the vehicle door.

* * * * *